US008254809B2

(12) United States Patent
Nishiuwatoko

(10) Patent No.: US 8,254,809 B2
(45) Date of Patent: Aug. 28, 2012

(54) ELECTROPHOTOGRAPHIC IMAGE FORMING APPARATUS

(75) Inventor: Tsutomu Nishiuwatoko, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 182 days.

(21) Appl. No.: 12/883,391

(22) Filed: Sep. 16, 2010

(65) Prior Publication Data

US 2012/0003005 A1 Jan. 5, 2012

(30) Foreign Application Priority Data

Jul. 5, 2010 (JP) ..... 2010-152817

(51) Int. Cl.
*G03G 15/08* (2006.01)

(52) U.S. Cl. ..... 399/121

(58) Field of Classification Search ..... 399/121, 399/308, 312, 317
See application file for complete search history.

(56) References Cited

U.S. PATENT DOCUMENTS 6,141,513 A 10/2000 Nishiuwatoko et al.
2010/0189474 A1 7/2010 Nishiuwatoko
2010/0239308 A1 9/2010 Kikuchi et al.
2010/0239312 A1 9/2010 Kikuchi et al.
2010/0247138 A1 9/2010 Kikuchi et al.
2010/0247140 A1 9/2010 Kikuchi et al.
2010/0247142 A1 9/2010 Kikuchi et al.

FOREIGN PATENT DOCUMENTS

JP 2006-184901 A 7/2006
JP 2010-175621 A 8/2010

*Primary Examiner* — Walter L Lindsay, Jr.
*Assistant Examiner* — Barnabas Fekete
(74) *Attorney, Agent, or Firm* — Fitzpatrick, Cella, Harper & Scinto

(57) ABSTRACT

An electrophotographic image forming apparatus, including: a plurality of electrophotographic photosensitive drums; a transfer unit for rotatably supporting a transfer member for transferring toner images formed on the drums onto the recording medium, the transfer unit being movable, with the transfer member being in contact with at least one of the drums, between a mounting position inside an apparatus main body for mounting the transfer unit to the main body and a removing position outside the main body for removing the transfer unit; and a rotative force generating unit for generating a rotative force for rotating the transfer member in association with the movement of the transfer unit when the transfer unit is moved from the mounting position to the removing position and when the transfer unit is moved from the removing position to the mounting position.

14 Claims, 14 Drawing Sheets

ELECTROPHOTOGRAPHIC IMAGE FORMING APPARATUS

BACKGROUND OF THE INVENTION

1. Field of the Invention

The present invention relates to an electrophotographic image forming apparatus.

2. Description of the Related Art

As an electrophotographic image forming apparatus, which forms a multi-color image or a full-color image by using an electrophotographic printing method, there has been known an image forming apparatus of an inline type or a tandem type, including a plurality of photosensitive members which are aligned substantially in a line. Here, the electrophotographic image forming apparatus is an apparatus that forms an image on a recording medium by using an electrophotographic image forming process. As the electrophotographic image forming apparatus, there are exemplified, for example, an electrophotographic copying machine, an electrophotographic printer (for example, color laser beam printer and color LED printer), a multi-function printer (MFP), a facsimile machine, and a word processor. The electrophotographic image forming apparatus forms toner images of different colors (for example, yellow, magenta, cyan, and black) on respective multiple image bearing members (hereinafter referred to as a photosensitive drum). The toner images of different colors are sequentially transferred onto a recording medium to be superimposed. The superimposed toner images are heated and pressurized to be fixed onto the recording medium, to thereby form a color image. Here, the recording medium is one on which an image is formed by the electrophotographic image forming apparatus, and paper, an OHP sheet, cloth, and the like are included therein, for instance.

Around the photosensitive drum, process means such as a charging means, an exposing means, a developing means, a transfer means, and a cleaning means, are arranged. Note that, there is known one in which a part of those process means is removably mounted, as a process cartridge, to a main body of the electrophotographic image forming apparatus. The process cartridge is removably mounted to the main body of the electrophotographic image forming apparatus, and contributes to an image forming process of forming an image on a recording medium. Here, in the process cartridge, at least one of the charging means, the developing means, and the cleaning means each serving as the process means and an electrophotographic photosensitive drum are integrated into a cartridge, and the process cartridge is removably mounted to the main body of the electrophotographic image forming apparatus. The process cartridge is removably mountable to the main body of the electrophotographic image forming apparatus by a user him/herself. Therefore, maintenance of the apparatus main body may easily be performed.

As the transfer method, there is known an intermediate transfer method, in which the toner images formed on the plurality of photosensitive drums are transferred in advance onto an intermediate transfer member, and then transferred onto a recording medium. As the intermediate transfer member, there is known a transfer means in which an intermediate transfer belt (transfer member) is used. In the transfer means of the intermediate transfer type, the toner images formed on the plurality of photosensitive drums are sequentially primarily transferred onto the intermediate transfer belt, and the plurality of toner images are superimposed on the intermediate transfer belt. Then, the toner images superimposed on the intermediate transfer belt are secondarily transferred on a recording medium.

As another transfer method, there is known a tandem method, in which the toner images formed on the plurality of photosensitive drums are sequentially transferred onto a recording medium on the transfer belt. The transfer belt used in the tandem method functions as a recording medium conveying member configured to convey a recording medium through electrostatic attraction. There is known a transfer means in which a transfer belt (transfer member) is used.

In order to facilitate the maintenance of the electrophotographic image forming apparatus (hereinafter referred to as an image forming apparatus), there is known an image forming apparatus in which the transfer means is removably mounted to the main body of the image forming apparatus (hereinafter referred to as an apparatus main body). The transfer means, which uses a transfer member, is movable between a mounting position inside the apparatus main body, at which the transfer means is mounted to the apparatus main body and a removing position outside the apparatus main body, at which the transfer means is removed from the apparatus main body. In such an image forming apparatus, the transfer means is moved between the mounting position and the removing position in a state in which the transfer member is in contact with the photosensitive drum, there is a fear of making a scratch on the photosensitive drum or the transfer member. The scratch marked on the photosensitive drum or the transfer member may cause a failure of image. In order to prevent the scratch marked on the photosensitive drum or the transfer member, there is proposed a structure in which, when pulling out the transfer means, the photosensitive drum is separated from the transfer member (Japanese Patent Application Laid-open No. 2006-184901).

SUMMARY OF THE INVENTION

The present invention has achieved a further development of the above-mentioned related art.

It is an object of the present invention to enhance operabilities at a time when a transfer means is removed from an electrophotographic image forming apparatus and at a time when the transfer means is mounted to the electrophotographic image forming apparatus.

It is another object of the present invention is to provide an electrophotographic image forming apparatus, in which the transfer means can be moved without making a scratch on the drum or the transfer member in a state in which the transfer member is in contact with at least one of a plurality of electrophotographic photosensitive drums.

The present invention provides an electrophotographic image forming apparatus including a transfer means which can be moved between a mounting position and a removing position in a state in which the transfer member is in contact with at least one of the drums.

In order to attain the above-mentioned objects, an electrophotographic image forming apparatus for forming an image on a recording medium, the electrophotographic image forming apparatus includes: a plurality of electrophotographic photosensitive drums; transfer means for rotatably supporting a transfer member for transferring toner images formed on the plurality of electrophotographic photosensitive drums onto the recording medium, the transfer means being movable, in a state in which the transfer member is in contact with at least one of the plurality of electrophotographic photosensitive drums, between a mounting position inside an apparatus main body of the electrophotographic image forming apparatus, at which the transfer means is mounted to the apparatus main body and a removing position outside the apparatus main body, at which the transfer means is removed from the apparatus main body; and rotative force generating means for generating a rotative force for rotating the transfer member in association with a movement of the transfer means when the transfer means is moved in a removing direction from the mounting position to the removing position and when the transfer means is moved in a mounting direction from the removing position to the mounting position.

According to the present invention, it is possible to enhance operabilities at the time when the transfer means is removed from the electrophotographic image forming apparatus and at the time when the transfer means is mounted to the electrophotographic image forming apparatus.

According to the present invention, the transfer means can be moved without making a scratch on the drum or the transfer member under the state in which the transfer member is in contact with at least one of the plurality of electrophotographic photosensitive drums.

According to the present invention, there can be provided an electrophotographic image forming apparatus including a transfer means which can be moved between a mounting position and a removing position in a state in which the transfer member is in contact with at least one of the drums.

Further features of the present invention will become apparent from the following description of exemplary embodiments with reference to the attached drawings.

DESCRIPTION OF THE EMBODIMENTS

Hereinafter, embodiments of the present invention are described with reference to the attached drawings.

Embodiment 1

(Electrophotographic Image Forming Apparatus)

Figure 1A:
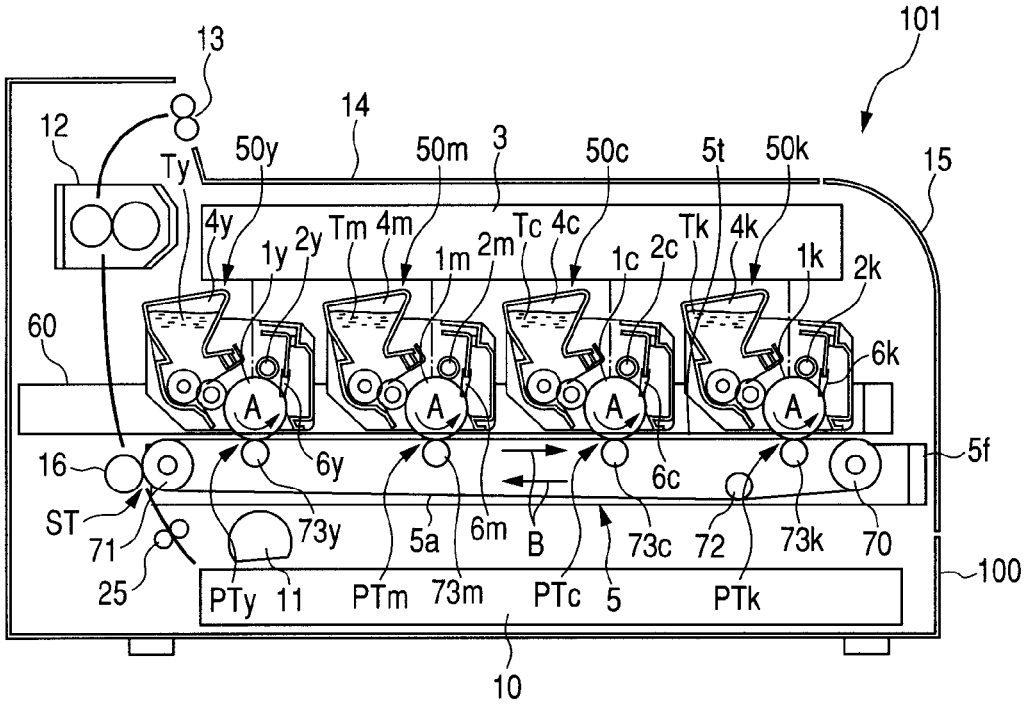
FIGS. 1A and 1B are sectional views of an image forming apparatus according to Embodiment 1 of the present invention.
Figure 1B:
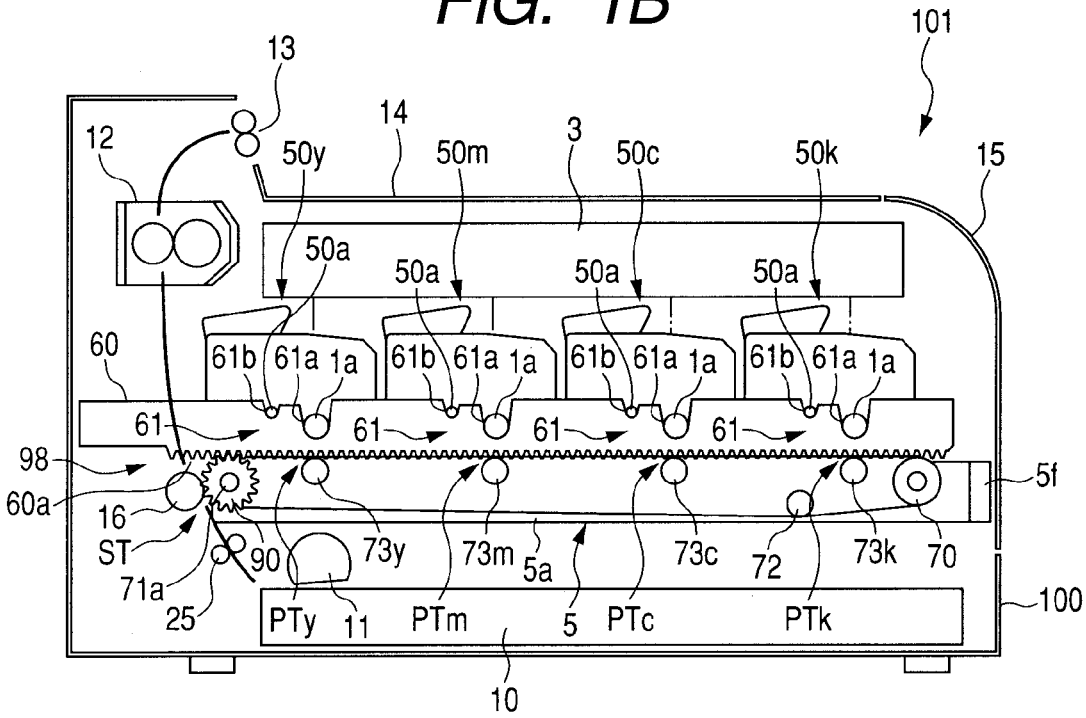
Figure 2:
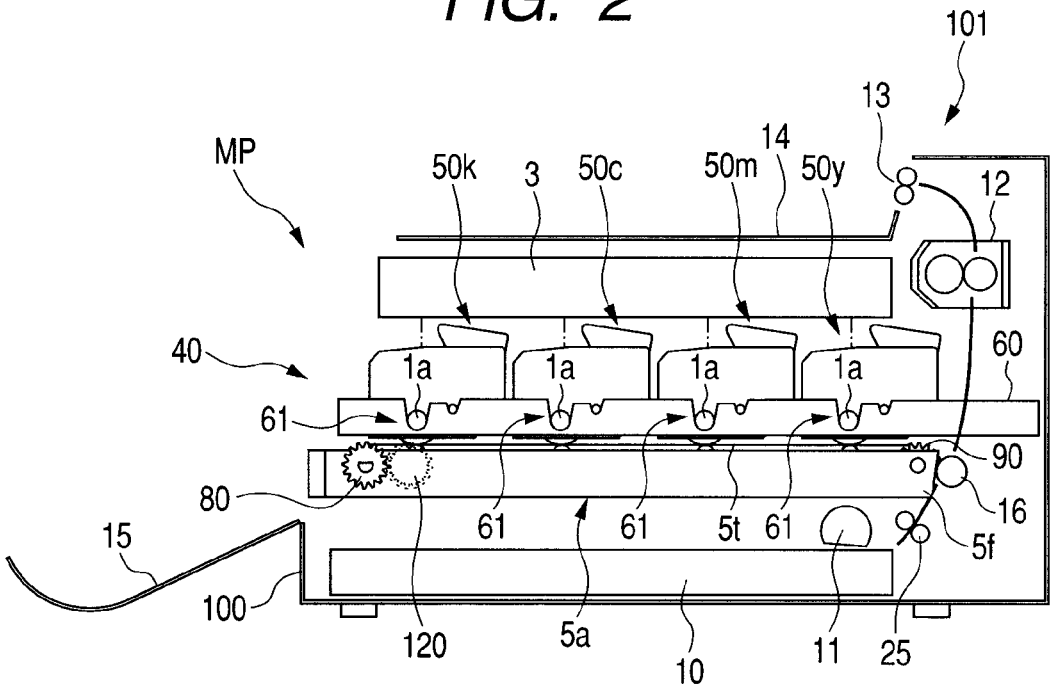
FIG. 2 is a sectional view of the image forming apparatus viewed from an opposite side to a side illustrated in FIGS. 1A and 1B.

FIGS. 1A and 1B are sectional views illustrating an electrophotographic image forming apparatus 101. FIG. 2 is a sectional view of the image forming apparatus viewed from an opposite side to a side illustrated in FIGS. 1A and 1B. In this embodiment, as one example, the electrophotographic image forming apparatus 101, which employs the so-called intermediate transfer method, will be described. In the intermediate transfer method, developer images (toner images) formed on a plurality of electrophotographic photosensitive members are primarily transferred and superimposed onto an intermediate transfer belt (an intermediate transfer member), and the superimposed toner images are secondarily transferred onto a recording medium to form a color image. However, the present invention may be applied to an electrophotographic image forming apparatus, which employs the so-called tandem method, in which toner images formed on the plurality of electrophotographic photosensitive members (electrophotographic photosensitive drums) are transferred and superimposed onto a recording medium on a transfer belt (a conveyor belt) to form a color image.

(Apparatus Main Body)

As illustrated in FIG. 1A, an apparatus main body 100 of the electrophotographic image forming apparatus 101 includes a sheet feeding cassette 10, a sheet feeding roller 11, a secondary transfer roller 16, a fixing unit 12, a pair of discharge rollers 13, and a delivery tray 14. Further, as illustrated in FIG. 2, the apparatus main body 100 includes an opening portion 40 and a door for opening and closing the opening portion 40 (an openable and closable member) 15. The apparatus main body 100 includes guide members (not shown) for supporting a process cartridge supporting member 60 movably. The supporting member 60 supports a plurality of process cartridges 50 (50*y*, 50*m*, 50*c*, and 50*k*), which being aligned in a line. In the apparatus main body 100, an exposure unit 3 is provided, and the exposure unit 3 is positioned above the cartridges 50. In the apparatus main body 100, the guide members (not shown) for movably supporting a transfer means 5 is provided.

It should be noted that the apparatus main body 100 refers to a structure in which the process cartridges 50, the process cartridge supporting member 60, and the transfer means 5 are removed from the electrophotographic image forming apparatus 101.

(Process Cartridge)

Figure 3A:
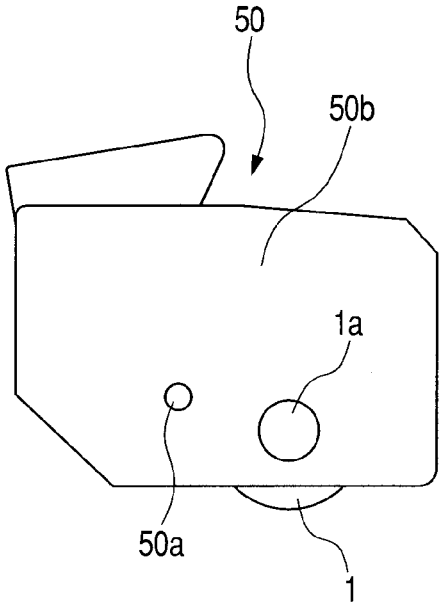
FIGS. 3A and 3B are diagrams each illustrating a process cartridge.
Figure 3B:
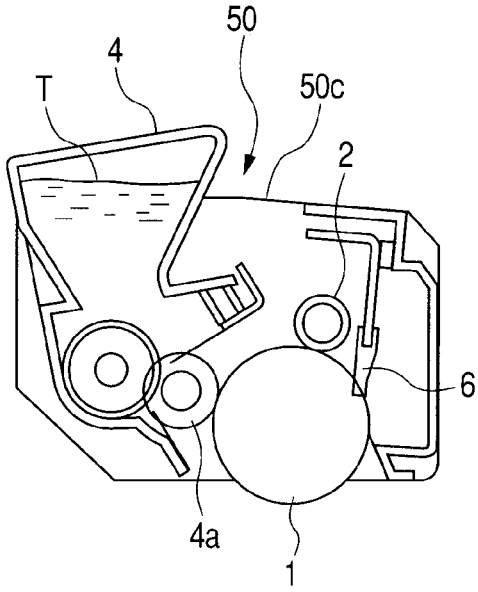

In the process cartridge supporting member 60, four process cartridges 50 (50*y*, 50*m*, 50*c*, 50*k*) are supported. FIG. 3A is a side view of a process cartridge. FIG. 3B is a sectional view of the process cartridge. As illustrated in FIG. 3A, a drum shaft 1*a* of the electrophotographic photosensitive drum (hereinafter referred to as a drum) 1 (1*y*, 1*m*, 1*c*, 1*k*) as an image bearing member and a positioning boss 50*a* each are formed on both sides 50*b* of the process cartridge 50. The drum 1 is rotatably supported by a frame 50*c* of the process cartridge 50. As illustrated in FIG. 3B, the cartridge 50 integrally includes the drum 1, and includes, as the process means, a charging roller (a charging member) 2, a developing roller (a developing member) 4*a*, and a cleaning blade (a cleaning member) 6. The process means acts on the drum 1. As illustrated in FIG. 1A, four cartridges 50 (50*y*, 50*m*, 50*c*, 50*k*) are aligned horizontally in a line. The charging rollers 2 (2*y*, 2*m*, 2*c*, 2*k*) charge the drums 1 (1*y*, 1*m*, 1*c*, 1*k*). The developing rollers 4*a* are provided in developing units 4 (4*y*, 4*m*, 4*c*, 4*k*), respectively. Each of the developing units 4 contains a different color of developers (hereinafter referred to as toner) T (Ty, Tm, Tc, Tk). The developing unit 4*y* contains a yellow toner Ty, the developing unit 4*m* contains a magenta toner Tm, the developing unit 4*c* contains a cyan toner Tc, and the developing unit 4*k* contains a black toner Tk. The developing roller 4*a* develops an electrostatic latent image formed on the drum 1 by using the toner T. Further, the cleaning blade 6 removes the residual toner T remained on the drum 1.

(Process Cartridge Supporting Member)

The process cartridge supporting member 60 is sliding-movably supported by the guide members (not shown) provided to the apparatus main body 100 in a state of supporting the process cartridges 50. Four cartridges 50 are aligned on the supporting member 60 in a line. The supporting member 60 is movable, in a state of supporting the plurality of cartridges, between an inside position positioned inside the apparatus main body 100 and an outside position positioned outside the apparatus main body 100. As illustrated in FIG. 1B, the cartridges 50 are mounted to mounting portions 61 of the supporting member 60. Each of the mounting portions 61 includes a drum shaft receiving portion 61*a* for receiving the drum shaft 1*a* of the drum 1 and a boss receiving portion 61*b* for receiving the positioning boss 50*a* provided on the cartridge 50. The drum shaft 1*a* and positioning bosses 50*a* are positioning means for positioning the cartridges 50 to the mounting portions 61 (drum shat bearing portions 61*a* and boss receiving portions 61*b*). The supporting member 60 is linearly movable through the opening portion 40 of the apparatus main body 100, in a state of supporting the plurality of cartridges 50, between an inside position at which the supporting member 60 is positioned inside the apparatus main body 100 and an outside position at which the supporting member 60 is positioned outside the apparatus main body 100. When the supporting member 60 is positioned at the outside position, the cartridges 50 are removed from the supporting member 60, or may be supported by the supporting member 60. At a lower portion of the supporting member 60, there is formed a rack portion 60*a*.

(Transfer Means)

The transfer means transfers the toner images formed on the drums 1 onto a recording medium or the intermediate transfer member. The transfer means 5 of Embodiment 1 is an intermediate transfer means including the intermediate transfer member (an intermediate transfer belt (a transfer member)) 5*a*. However, the present invention is not limited to the intermediate transfer means. The transfer means may be a tandem type, which includes a recording medium conveying member (a conveyor belt (a transfer member)), and in which the toner images formed on the plurality of photosensitive drums are sequentially transferred and superimposed onto a recording medium on the conveyor belt. Hereinafter, description will be provided of Embodiment 1 of the present invention by way of the intermediate transfer means as an example. The transfer means 5 rotatably supports the transfer member (hereinafter referred to as a belt) 5*a* for transferring the toner images formed on the plurality of drums 1*y*, 1*m*, 1*c*, and 1*k* onto a recording medium. The transfer means 5 is linearly movable between a mounting position MP (FIG. 4A) inside the apparatus main body 100 at which the transfer means 5 is mounted to the apparatus main body 100 and a removing position DP (FIG. 4B) outside the apparatus main body 100 at which the transfer means 5 is removed from the apparatus main body 100. In this Embodiment, the transfer means 5 includes a belt 5*a*, a first suspension roller 70, a second suspension roller 71, a tension roller 72, a primary transfer roller 73, and a transfer frame (an intermediate transfer member supporting member) 5*f*. However, the transfer means 5 is not limited thereto. The transfer means 5 may be the one as long as which rotatably supports the belt 5*a*. The roller 70 and the roller 71 are rotatably supported by the transfer frame 5*f* of the transfer means 5. The belt 5*a* is looped around the roller 70 and the roller 71. The first suspension roller (a first rotary member) 70 is disposed on a downstream side of the transfer means 5 in the removing direction described later. The second suspension roller (a second rotary member) 71 is disposed on an upstream side of the transfer means 5 in the removing direction. Specifically, when the transfer means 5 is disposed at the mounting position described later, the roller 70 is disposed in the vicinity of the opening portion 40 at the front part of the apparatus main body 100, and the roller 71 is disposed so as to abut the secondary transfer roller 16 at the inner part of the apparatus main body 100. A rotative force generating means 98 described later generates a rotative force for rotating the roller 71 disposed on an upstream side of a removing direction MX. Accordingly, the rotative force generating means 98 may generate the rotative force until the transfer means 5 reaches the removing position DP. Between the roller 70 and the roller 71, a plurality of primary transfer rollers (73*y*, 73*m*, 73*c*, 73*k*) are rotatably supported by the transfer frame 5*f*. The roller 70, the roller 71, and the primary transfer rollers 73 are disposed substantially in parallel with an arrangement direction of the plurality of drums 1. The belt 5*a* forms a primary transfer surface 5*t* forming a substantially flat surface between the roller 70 and the roller 71. The belt 5*a* is in contact with the plurality of drums 1 at the primary transfer surface 5*t*. The plurality of primary transfer rollers 73 abut the plurality of drums 1 (1*y*, 1*m*, 1*c*, 1*k*) via the belt 5*a*, respectively, to thereby form primary transfer portions PT (PTy, PTm, PTc, PTk) between the belt 5*a* and the drums 1. The tension roller 72 is rotatably supported by the transfer frame 5*f*, and is movable so as to apply a tension force to the belt 5*a*. The transfer means 5 is an intermediate transfer member cartridge in which the belt 5*a*, the first suspension roller 70, the second suspension roller 71, the tension roller 72, and the primary transfer rollers 73 are integrally incorporated into the transfer frame 5*f*. The transfer means 5 is removably mounted to the apparatus main body 100 of the image forming apparatus 101.

Figure 4A:
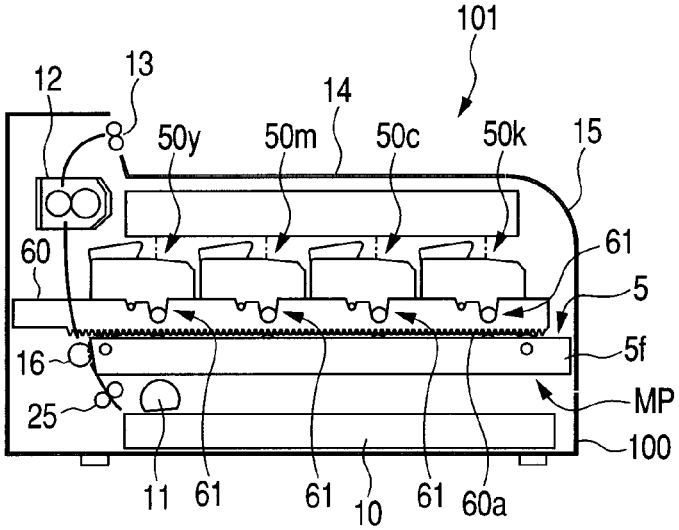
FIGS. 4A and 4B are partially sectional views of the image forming apparatus, illustrating a mounting position and a removing position of a transfer means.
Figure 4B:
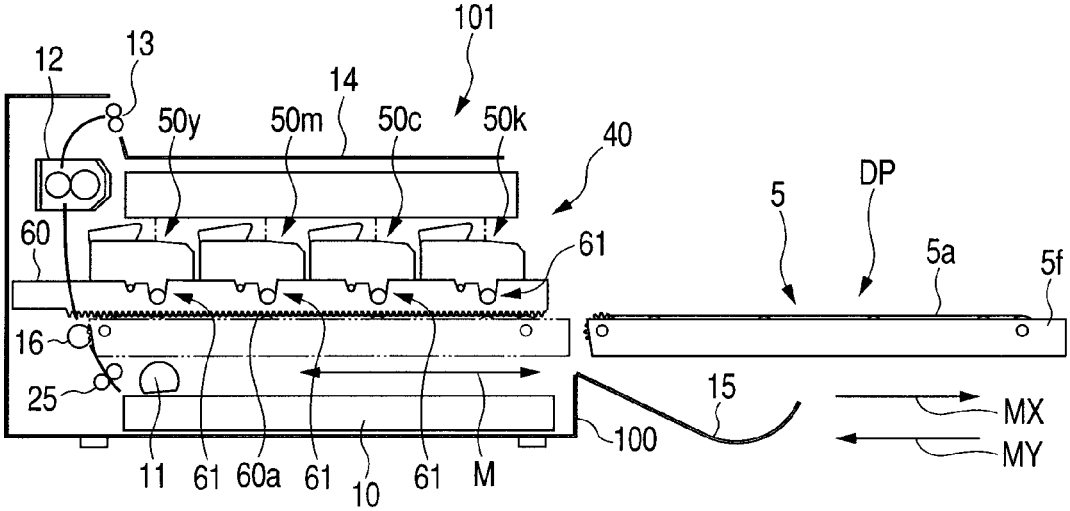

FIGS. 4A and 4B are partially sectional views of the electrophotographic image forming apparatus, for illustrating the mounting position MP and the removing position DP of the transfer means 5. The transfer frame 5*f* is linearly movable, by the guide members (not shown) provided in the apparatus main body 100, between the mounting position MP (FIG. 4A) inside the apparatus main body at which the transfer frame 5*f* is mounted to the apparatus main body and the removing position DP (FIG. 4B) outside the apparatus main body at which the transfer frame 5*f* is removed from the apparatus main body. The transfer frame 5*f* is supported by the guide members (not shown) so as to be movable substantially in parallel with the primary transfer surface 5*t*. Therefore, the transfer means 5 is movable along a straight line passing the center axes of the plurality of drums 1, namely, linearly movable along the primary transfer surface 5*t* between the mounting position MP and the removing position DP. The transfer means 5 is movable between the mounting position MP and the removing position DP in a state in which the belt 5*a* is in contact with at least one of the plurality of drums 1.

At one end portion of the roller 70 (on the opposite side to the side illustrated in FIGS. 1A and 1B, i.e., the side illustrated in FIG. 2), a first driven gear 80 is fixed. As illustrated in FIG. 2, when the transfer means 5 is positioned at the mounting position MP, the driven gear 80 is meshed with an intermediate gear 120, which constitutes a gear train (illustrated by the broken line in FIG. 2). At the time of image formation, a drive force of a motor (not shown) as a drive means is transmitted to the roller 70 through the intermediate gear 120 and the driven gear 80. Due to the rotation of the roller 70, the belt 5*a* is rotated to perform an image forming process.

The belt 5*a* of this embodiment is an intermediate transfer belt onto which the toner images formed on the plurality of drums 1 are primarily transferred and superimposed and which secondarily transfers the superimposed toner images onto a recording medium. However, the present invention is not limited thereto. The belt 5*a* may be a transfer belt, which conveys a recording medium and transfers the toner images formed on the plurality of drums 1 onto the recording medium.

(Image Forming Process)

At the time of image formation, first, the drums are rotated in a direction (the counterclockwise direction) indicated by the arrow A in FIG. 1A in synchronism with the rotation of the belt 5*a*. The belt 5*a* is rotated in a direction (the clockwise direction) indicated by the arrow B in FIG. 1A by a motor (not shown) through the driven gear 80. A surface of the drum 1*y* of a process cartridge 50*y* for yellow color is uniformly charged by a charging roller 2*y*. The exposure unit 3 conducts a selective exposure in accordance with image information, to thereby form an electrostatic latent image of yellow color on the surface of the drum 1*y*. To develop the electrostatic latent image of yellow color, voltage having the same polarity and substantially the same potential as a charged polarity of the drum 1*y* is applied to the developing roller 4*a* (FIG. 3B) of the developing unit 4*y* for yellow color. With this application, a yellow toner is caused to adhere onto the electrostatic latent image for yellow color formed on the drum 1*y*, to thereby form a yellow toner image. After that, voltage having a reverse polarity to the toner is applied to the primary transfer roller 73*y* disposed inside the belt 5*a*, to thereby primarily transfer the yellow toner image formed on the drum 1*y* onto the belt 5*a* at a primarily transfer portion PTy. After completion of the primarily transfer of the yellow toner image, a magenta toner image, a cyan toner image, and a black toner image are formed by the process cartridges 50*m*, 50*c*, and 50*k* for magenta, cyan, and black colors. The respective toner images are sequentially primarily transferred and superimposed onto the belt 5*a* by the primary transfer rollers 73*m*, 73*c*, and 73*k* at the respective primarily transfer portions PTm, PTc, and PTk. The sheet feeding roller 11 separates one by one recording media (sheets) contained in the sheet feeding cassette 10 to feed a recording medium to a registration roller pair 25. The registration roller pair 25 conveys a recording medium to a secondarily transfer portion ST between the belt 5*a* and the secondary transfer roller 16 in synchronism with timing of the toner images superimposed on the belt 5*a*. Voltage having a reverse polarity to the toner is applied to the secondary transfer roller 16. Four color toner images superimposed on the belt 5*a* are secondarily transferred collectively onto a recording medium, which has been conveyed. The recording medium on which the toner images are transferred is conveyed to the fixing unit 12. At the fixing unit 12, the toner images are pressurized and heated, thereby being fixed onto the recording medium. With this operation, a color image is formed on the recording medium. The recording medium is discharged by the discharge rollers 13 onto the delivery tray 14. On the other hand, residual toners remaining on the drums 1 after the primarily transfer are removed by the cleaning blades 6. The drums 1 are used again for an image forming processing starting from the charging.

(Rotative Force Generating Means)

The rotative force generating means 98 according to this embodiment will be described hereinbelow. The rotative force generating means 98 generates, when the transfer means 5 is moved from the mounting position MP to the removing position DP in the removing direction MX (FIG. 4B), a rotative force for rotating the belt 5*a* in association with the movement of the transfer means 5. Further, the rotative force generating means 98 generates, when the transfer means 5 is moved from the removing position DP to the mounting position MP in a mounting direction MY, a rotative force for rotating the belt 5*a* in association with the movement of the transfer means 5. The rotative force generating means 98 functions as a conversion unit for converting the moving force of the transfer means 5 moved by hand or electromotion to the rotative force of the belt 5*a*. The rotative force generating means 98 of this embodiment includes the rack portion 60*a* extending along a movement route M of the transfer means 5, which moves between the mounting position MP and the removing position DP. The rotative force generating means 98 includes a second driven gear (a driven gear) 90, which is rotatably supported by a rotation shaft 71*a* of the roller 71, and meshes with the rack portion 60*a*. The rotative force generating means 98 includes a clutch means 96, which assumes a transmitting position for transmitting the rotative force of the driven gear 90, which rotates by being meshed with the rack portion 60*a*, to the roller 71, and assumes a shutoff position for shutting the transmission of the rotative force from the roller 71 to the driven gear 90. As the rotative force generating means 98 generates the rotative force in association with the movement of the transfer means 5, there is no need to separately provide a driving source for generating a rotative force.

The rotative force generating means 98 generates, when the transfer means 5 is moved from the mounting position MP to the removing position DP in the removing direction MX, a rotative force in association with the movement of the transfer means 5, to thereby rotate the belt 5*a* in one direction. With this operation, the transfer surface 5*t* of the belt 5*a*, which is in contact with at least one of the plurality of drums 1, is moved in a direction opposite to the removing direction MX with respect to the transfer means 5. Further, the rotative force generating means 98 generates, when the transfer means 5 is moved from the removing position DP to the mounting position MP in the mounting direction MY, a rotative force in association with the movement of the transfer means 5, to thereby rotate the belt 5*a* in a direction opposite to the one direction. With this operation, the transfer surface 5*t* of the belt 5*a* is moved in a direction opposite to the mounting direction MY with respect to the transfer means 5. Accordingly, it is possible to prevent a scratch from being marked on the surface of the drum 1 or the surface of the belt 5*a* by reducing a relative speed at a contact area between the drum 1 and the belt 5*a*.

When the transfer means 5 is moved from the mounting position MP to the removing position DP, the rotative force generating means 98 keeps the relative speed between the drum and the belt 5*a* at zero at a position at which at least one of the plurality of drums 1 is in contact with the belt 5*a*. When the transfer means 5 is moved from the removing position DP to the mounting position MP, the rotative force generating means 98 keeps the relative speed between the drum and the belt 5*a* at zero at a position at which at least one of the plurality of drums 1 is in contact with the belt 5*a*. With this structure, even if the belt 5*a* is in contact with the drums 1, it is possible to prevent a scratch from being marked on the surface of the drums 1 or the surface of the belt 5*a* because of the reduction in rubbing of the belt 5*a* against the drums 1.

Figure 5A:
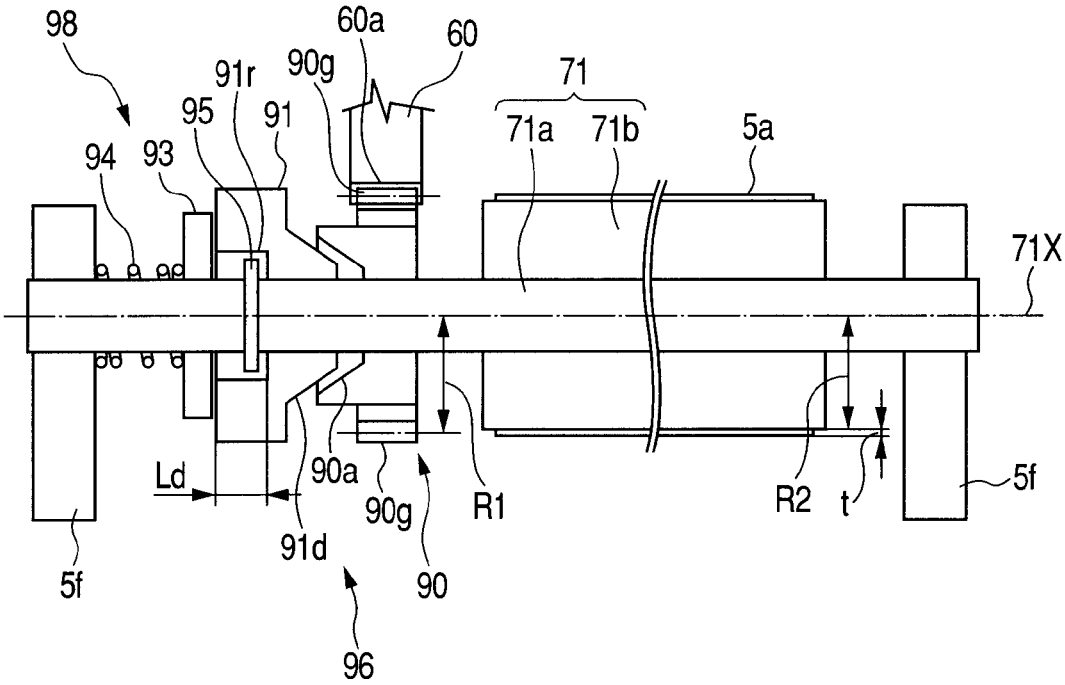
FIGS. 5A and 5B are diagrams illustrating a rotative force generating means.
Figure 5B:
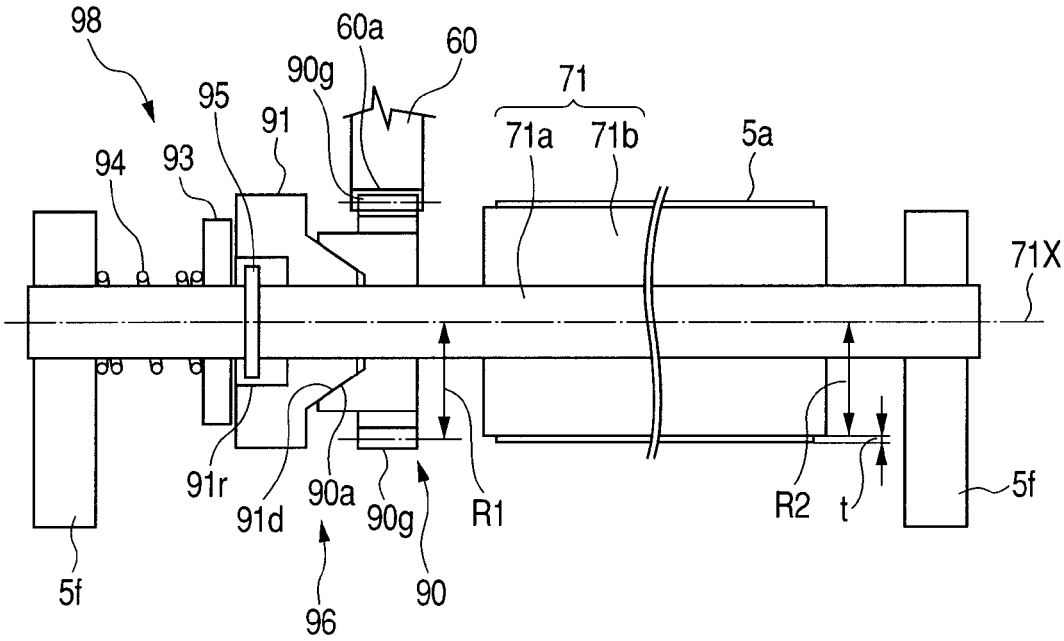

As illustrated in FIGS. 5A and 5B, the roller 71 includes the rotation shaft 71*a*, and a rubber layer 71*b* provided on the shaft 71*a*. Both end portions of the shaft 71*a* are rotatably supported by the frame 5*f* of the transfer means 5. At one end portion of the shaft 71*a*, the driven gear 90, a clutch cone 91, a washer 93, and a clutch spring (an urging member) 94 are arranged. The driven gear 90 is rotatably supported with respect to the shaft 71*a*. The driven gear 90 includes a tooth portion 90*g* on its outer periphery, and includes a concave clutch surface 90*a*, which is a conical concave surface, on one side surface thereof. The tooth portion 90*g* meshes with the rack portion 60*a* provided at the lower portion of the supporting member 60. As illustrated in FIG. 4B, the rack portion 60*a* extends along the movement route M of the transfer means 5. Note that, in this embodiment, the rack portion 60*a* is provided at the lower portion of the supporting member 60, but is not limited thereto. The rack portion 60*a* may be provided in the apparatus main body 100 as long as being extended along the movement route M of the transfer means 5, which moves between the mounting position MP and the removing position DP. As illustrated in FIG. 5A, the tooth portion 90*g* is set so that its reference pitch circle radius R1 has the same value with a value obtained by adding a thickness "t" of the belt 5*a* to an outer peripheral surface radius R2 of the rubber layer 71*b* of the second suspension roller 71. Further, the position of the second driven gear 90 in an axial direction 71X of the shaft 71*a* is regulated by the regulating member (not shown) so that the tooth portion 90*g* of the driven gear 90 engages with the rack portion 60*a*. Specifically, the driven gear 90 is rotatably supported with respect to the shaft 71*a*, but the movement of the driven gear 90 in the axial direction is regulated by the regulating member (not shown) so as not to move in the axial direction 71X.

The clutch cone 91 includes, at one side surface, a convex clutch surface 91*d*, which is a conical convex surface, and a rotation regulating groove 91*r* at the other side surface. The clutch cone 91 is supported by the shaft 71*a* so that a convex clutch surface 91*d* opposes the concave clutch surface 90*a* of the driven gear 90. A parallel pin extending through the shaft 71*a* is inserted into the rotation regulating groove 91*r* of the clutch cone 91. The rotation regulating groove 91*r* is always locked with the parallel pin 95, the clutch cone 91 rotates integrally with the shaft 71*a*. As illustrated in FIG. 5A, the rotation regulating groove 91*r* has a depth Ld in the direction of the axis line 71X of the shaft 71*a*, and hence the clutch cone 91 is movable along the axis line 71X. The washer 93 and the clutch spring 94 are also supported by the shaft 71*a*. The washer 93 is disposed adjacent to the clutch cone 91 to abut the other side surface of the clutch cone 91. The clutch spring (the urging means) 94 is a compression spring (an elastic member), and is disposed between the washer 93 and the frame 5*f*. The clutch spring 94 urges the clutch cone 91 toward the driven gear 90 via the washer 93.

When the transfer means 5 is positioned inside the apparatus main body 100 at the mounting position MP at which the transfer means 5 is mounted to the apparatus main body 100, and the door 15 is in a closed state (FIG. 4A), a link mechanism (not shown) as an interlocking means is engaged with the clutch cone 91. The link mechanism engages with the clutch cone 91, and separates the clutch cone 91 from the driven gear 90 against the urging force of the spring 94 (FIG. 5A). The concave clutch surface 90*a* of the driven gear 90, the convex clutch surface 91*d* of the clutch cone 91, the clutch spring 94, and the link mechanism (not shown) constitute the clutch means 96. At the time of the image formation, a driving force is transmitted from a motor (not shown) to the roller 70 through the intermediate gear 120 and the driven gear 80 (FIG. 2), and the belt 5*a* is rotated in the direction indicated by the arrow B (FIG. 1A). At this time, the roller 71 is rotated by the belt 5*a*, and the clutch cone 91 rotates integrally with the rotation of the roller 71. However, the convex clutch surface 91*d* of the clutch cone 91 is separated from the concave clutch surface 90*a* of the driven gear 90, and hence the driven gear 90 does not rotate.

Specifically, when the door 15 closes the opening portion 40, the link mechanism (not shown) causes the clutch means 96 to position at the shutoff position. At the shutoff position, the clutch cone 91 is separated from the second driven gear 90 (FIG. 5A), and hence the transmission of the rotative force from the second suspension roller 71 to the second driven gear 90 is shuttled off.

Figure 6A:
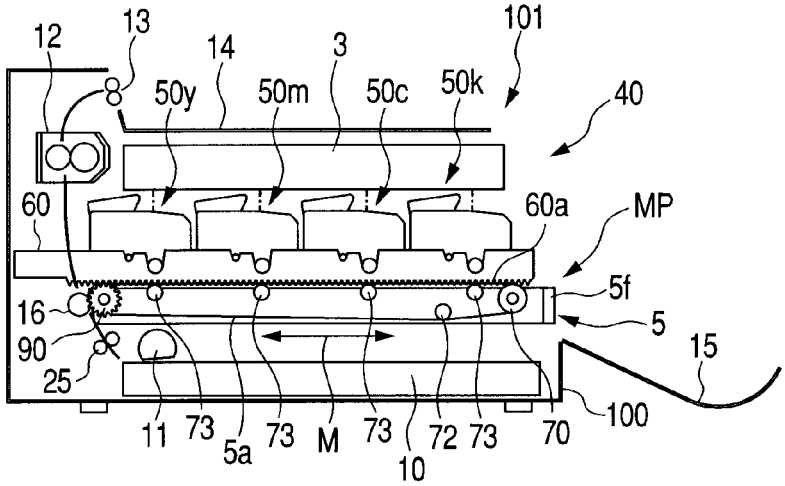
FIGS. 6A, 6B, and 6C are partially sectional views of the image forming apparatus, illustrating a removal and mounting of the transfer means.
Figure 6B:
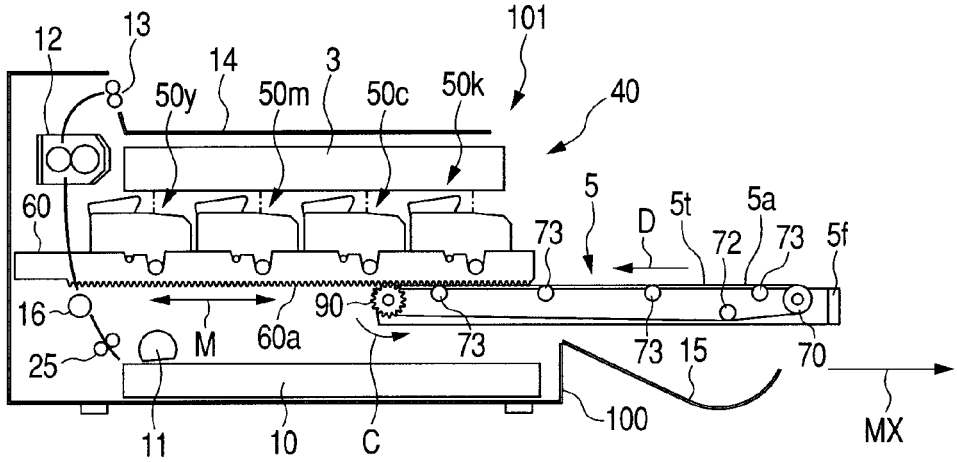
Figure 6C:
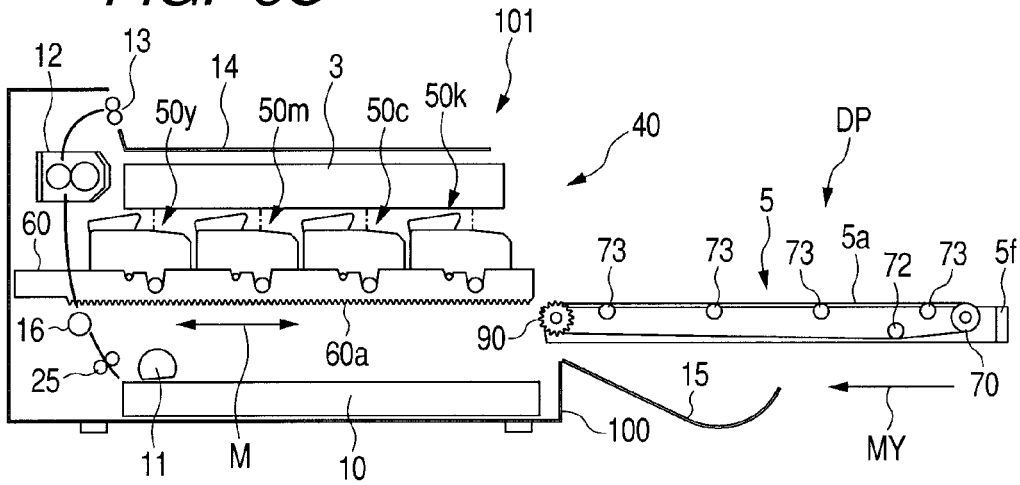

FIGS. 6A to 6C are partially sectional views of the electrophotographic image forming apparatus 101 illustrating the mounting and removing of the transfer means 5. When the door 15 is in an opened state (FIG. 6A), the engagement of the link mechanism (not shown) is released, and the clutch cone 91 is urged toward the driven gear 90 by an urging force of the clutch spring 94. The convex clutch surface 91*d* of the clutch cone 91 is in contact with the concave clutch surface 90*a* of the driven gear 90 (FIG. 5B). Through the friction engagement of the concave clutch surface 90*a* and the convex clutch surface 91*d*, the driven gear 90 and the clutch cone 91 become rotatable integrally with each other. Therefore, if the driven gear 90 rotates, the clutch cone 91 and the roller 71 rotate integrally with the driven gear 90.

Specifically, when the door 15 opens the opening portion 40, the link mechanism (not shown) causes the clutch means 96 to position at the transmitting position. At the transmitting position, the rotative force of the driven gear 90, which rotates by being meshed with the rack portion 60*a*, is transmitted to the roller 71.

In FIG. 6A, the transfer means 5 is positioned at the mounting position MP. If a user pulls out the transfer means 5 in the removing direction indicated by the arrow MX (FIG. 6B), the driven gear 90 is rotated by the rack portion 60*a* of the supporting member 60 in a direction indicated by an arrow C in association with the movement of the transfer means 5 along the movement route M. The clutch cone 91 and the roller 71 integrally rotate together with the driven gear 90 to cause the belt 5*a* to rotate in the direction indicated by the arrow C. At this time, a movement direction D of the belt 5*a* on the side of the primary transfer surface 5*t* becomes an opposite direction to the removing direction MX of the transfer means 5. With this, the relative speed at the contact area between the drum 1 and the belt 5*a* is made smaller, thereby being capable of preventing a scratch from being marked on the surfaces of the drums 1 or the surface of the belt 5*a*. In this embodiment, as illustrated in FIG. 5B, the tooth portion 90*g* of the driven gear 90 is set so that its reference pitch circle radius R1 has the same value as a value obtained by adding a thickness "t" of the belt 5*a* to an outer peripheral surface radius R2 of the rubber layer 71*b* of the roller 71. Therefore, on the side of the primary transfer surface 5*t*, the belt 5*a* moves in the direction D which is opposite to the removing direction MX of the transfer means 5 at the same magnitude of speed as the pull-out speed of the transfer means 5. In other words, the movement amount of the transfer means 5 substantially coincides with the movement amount of the primary transfer surface 5*t* of the belt 5*a*. Therefore, at the contact area between the belt 5*a* and the drum 1, the primary transfer surface 5*t* of the belt 5*a* moves in the direction opposite to the movement direction of the transfer means 5 at substantially the same speed. With this operation, the relative speed between the drums 1 of the cartridges 50 supported by the supporting member 60 and the primary transfer surface 5*t* of the belt 5*a* becomes substantially zero. In other words, at the contact areas between the belt 5*a* and the drums 1, the belt 5*a* does not relatively move with respect to the drums 1. Accordingly, even if the belt 5*a* is in contact with the drums 1, it is possible to prevent a scratch from being marked on the surfaces of the drums 1 or the surface of the belt 5*a* because of the reduction in rubbing of the belt 5*a* against the drums 1. As the transfer means 5 may be moved while the belt 5*a* is in contact with the drums 1, the transfer means 5 may be removed from the apparatus main body 100 by only moving the transfer means 5 toward one direction from the mounting position MP. Accordingly, the operation at the time of removing the transfer means 5 is facilitated.

When the transfer means 5 is moved from the mounting position MP to the removing position DP along the movement route M, the belt 5*a* is first moved in contact with the respective drums 1*y*, 1*m*, 1*c*, and 1*k* of four cartridges 50. If the contact of the belt 5*a* with the drum 1*y* is released, the belt 5*a* is moved in contact with three drums 1*m*, 1*c*, and 1*k*. In addition, if the contact of the belt 5*a* with the drum 1*m* is released, the belt 5*a* is moved in contact with two drums 1*c* and 1*k*. Then, if the contact of the belt 5*a* with the drum 1*c* is released, the belt 5*a* is moved in contact with the drum 1*k*. Specifically, the transfer means 5 is capable of moving from the mounting position MP to the removing position DP in a state in which the belt 5*a* is in contact with at least one of the plurality of drums 1. It should be noted that some of the plurality of drums may be constructed so as to be contactable with and separable from the belt 5*a*. Even in such cases, the transfer means 5 is movable between the mounting position MP and the removing position DP in a state in which the belt 5*a* is in contact with at least one of the plurality of drums.

When the transfer means 5 is further moved in the removing direction MX, the engagement between the driven gear 90 and the rack portion 60*a* is released, and the transfer means 5 reaches the removing position DP. The transfer means 5 is removed from the apparatus main body 100, at the removing position DP, by removing to-be-guided portions (not shown) provided on the transfer means 5 from the guide portions (not shown) provided in the apparatus main body 100.

When the transfer means 5 is mounted to the apparatus main body 100, a reverse operation to the above-mentioned removing operation is performed. The user engages, at the removing position DP, the to-be-guided portions provided on the transfer means 5 with the guide portions (not shown) provided in the apparatus main body 100. If the transfer means 5 is pushed into the mounting direction indicated by an arrow MY in FIG. 6C, the driven gear 90 engages with the rack portion 60*a*. In association with the movement of the transfer means 5 in the mounting direction MY along the movement route M, the driven gear 90 is rotated in a direction opposite to a direction indicated by an arrow C by the rack portion 60*a* of the supporting member 60. The clutch cone 91 and the roller 71 are integrally rotated together with the driven gear 90, to thereby rotate the belt 5*a* in the direction opposite to the direction indicated by the arrow C. At this time, the movement direction (opposite to the direction indicated by the arrow D) of the belt 5*a* on the side of the primary transfer surface 5*t* becomes the direction opposite to the mounting direction MY of the transfer means 5. With this, the relative speed at the contact area between the drum 1 and the belt 5*a* is made smaller, thereby being capable of preventing a scratch from being marked on the surfaces of the drums 1 or the surface of the belt 5*a*. In this embodiment, on the side of the primary transfer surface 5*t*, the belt 5*a* moves to a direction which is opposite to the mounting direction MY of the transfer means 5 at the same magnitude of speed with the push-in speed of the transfer means 5. With this operation, the relative speed at the contact areas between the drum 1 of the cartridges 50 supported by the supporting member 60 and the primary transfer surface 5*t* of the belt 5*a* become substantially zero. Accordingly, even if the belt 5*a* is in contact with the drums 1, it is possible to prevent a scratch from being marked on the surfaces of the drums 1 or the surface of the belt 5*a* because of the reduction in rubbing of the belt 5*a* against the drums 1. As the transfer means 5 may be moved while the belt 5*a* is in contact with the drums 1, the transfer means 5 may be mounted to the apparatus main body 100 by only moving the transfer means 5 from the removing position DP to the mounting direction MY. Accordingly, the operation at the time of mounting the transfer means 5 is facilitated.

When the transfer means 5 is moved from the removing position DP to the mounting position MP, the belt 5*a* is brought into contact with the drum 1*k* and the transfer means 5 is moved in contact with one drum 1*k*. Next, the belt 5*a* is brought into contact with the drum 1*c* and the belt 5*a* is moved in contact with two drums 1*c* and 1*k*. The belt 5*a* is further brought into contact with the drum 1*m* and the belt 5*a* is moved in contact with three drums 1*m*, 1*c*, and 1*k*. Then, the belt 5*a* is brought into contact with the drum 1*y* and the belt 5*a* is moved in contact with four drums 1*y*, 1*m*, 1*c*, and 1*k*. That is, the transfer means 5 is movable from the removing position DP to the mounting position MP in a state in which the belt 5*a* is in contact with at least one of the plurality of drums 1.

It should be noted that, in this embodiment, there is used as the clutch means the so-called cone clutch mechanism, which causes the conical-shaped convex clutch surface 91*d* and the concave clutch surface 90*a* to contact and separate from each other. In order to prevent more positively the sliding between the convex clutch surface 91*d* and the concave clutch surface 90*a* from occurring, a rubber layer may be formed on one of or both of the convex clutch surface 91*d* and the concave clutch surface 90*a*. Further, the clutch means is not limited to the cone clutch mechanism, but another clutch mechanism such as a flat plate clutch and a dog clutch may be used.

Embodiment 2

Hereinafter, a description will be provided of Embodiment 2 of the present invention. In the description of Embodiment 2, the same structure as in Embodiment 1 is denoted by the same reference symbol, and the description thereof is omitted. Further, a process cartridge and an image forming process of Embodiment 2 are the same as in Embodiment 1, and hence the description thereof is omitted.

(Image Forming Apparatus)

At a top of an apparatus main body 200 of an image forming apparatus 201, there is provided a delivery tray 214 for stacking sheets having an image formed thereon. The delivery tray 214 is provided rotatably with respect to the apparatus main body 200 by a hinge (not shown). The apparatus main body 200 is provided with an opening portion 220 through which the process cartridges 50 (50*y*, 50*m*, 50*c*, 50*k*) is mounted and removed from the apparatus main body 200.

The delivery tray 214 is rotatable between a closing position for closing the opening portion 220 and an opening position for opening the opening portion 220. The delivery tray 214 also functions as a cover for covering the opening portion 220. The delivery tray 214 is rotated to the opening position together with the exposure unit 3. When replacing the process cartridges 50, the delivery tray 214 is rotated to the opening position together with the exposure unit 3 to open the opening portion 220. Through the opening portion 220, the process cartridges 50 may be mounted and removed from the apparatus main body 200 from upward of the apparatus main body 200. Note that, the process cartridges 50 are the same as the process cartridges of Embodiment 1 as illustrated in FIGS. 3A and 3B.

(Transfer Means)

Figure 7:
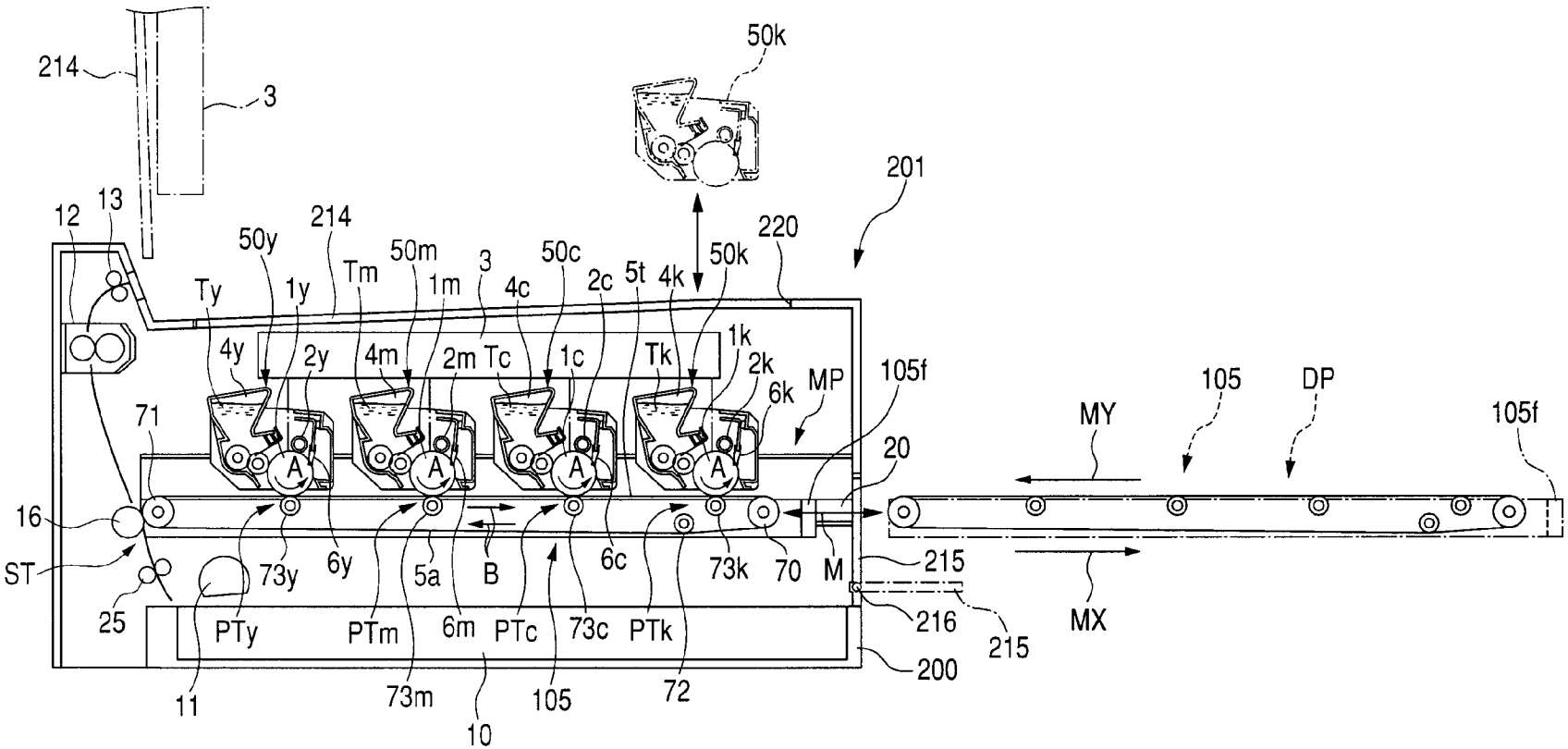
FIG. 7 is a sectional view illustrating an image forming apparatus according to Embodiment 2 of the present invention.

FIG. 7 is a sectional view of the image forming apparatus 201 according to Embodiment 2 of the present invention. The transfer means transfers toner images formed on the drums 1 onto a recording medium or the intermediate transfer member. The transfer means 105 of Embodiment 2 is a transfer member (hereinafter referred to as a belt) 5*a* for transferring the toner images formed on the plurality of drums 1*y*, 1*m*, 1*c*, and 1*k* onto a recording medium. The transfer means 105 is linearly movable between a mounting position MP inside the apparatus main body 200 at which the transfer means 5 is mounted to the apparatus main body 200 and a removing position DP (FIG. 4B) outside the apparatus main body 200 at which the transfer means 105 is removed from the apparatus main body 200. In this Embodiment, the transfer means 105 includes a transfer belt 5*a*, a first suspension roller 70, a second suspension roller 71, a tension roller 72, a primary transfer roller 73, and a transfer frame (an intermediate transfer member supporting member) 105*f*. However, the transfer means 105 is not limited thereto. The transfer means 105 may be the one as long as which rotatably supports the belt 5*a*. The first suspension roller 70, the second suspension roller 71, and the primary transfer rollers 73 are disposed substantially in parallel with an arrangement direction of the plurality of drums 1, and are rotatably supported by the transfer frame 105*f*. The belt 5*a* is suspended so as to form a first transfer surface 5*t* in which the belt 5*a* between the roller 70 and the roller 71 becomes a substantially flat surface. The belt 5*a* is in contact with the respective drums 1 at the first transfer surface 5*t*. The first suspension roller (a first rotary member) 70 is disposed downstream of the transfer means 105 in the removing direction. The second suspension roller (a second rotary member) 71 is disposed upstream of the transfer means 105 in the removing direction. A rotative force generating means 198 described later generates a rotative force for rotating the roller 71 disposed upstream in the removing direction MX. Accordingly, the rotative force generating means 198 may generate the rotative force until the transfer means 105 reaches the removing position DP in which the transfer means 105 can be removed from the apparatus main body 100. The transfer means 105 is an intermediate transfer member cartridge in which the belt 5*a*, the roller 70, the roller 71, the tension roller 72, and the primary transfer rollers 73 are integrally incorporated into the transfer frame 105*f*. The transfer means (the intermediate transfer member cartridge) 105 is removably mounted to the apparatus main body 200 of the image forming apparatus 201.

The belt 5*a* of this embodiment is an intermediate transfer belt, onto which the toner images formed on the plurality of drums 1 are primarily transferred and superimposed, and from which the superimposed toner images are secondarily transferred onto a recording medium. However, the present invention is not limited thereto. The belt 5*a* may be a transfer belt, which conveys a recording medium so that the toner images formed on the plurality of drums 1 are transferred onto the recording medium.

Figure 8A:
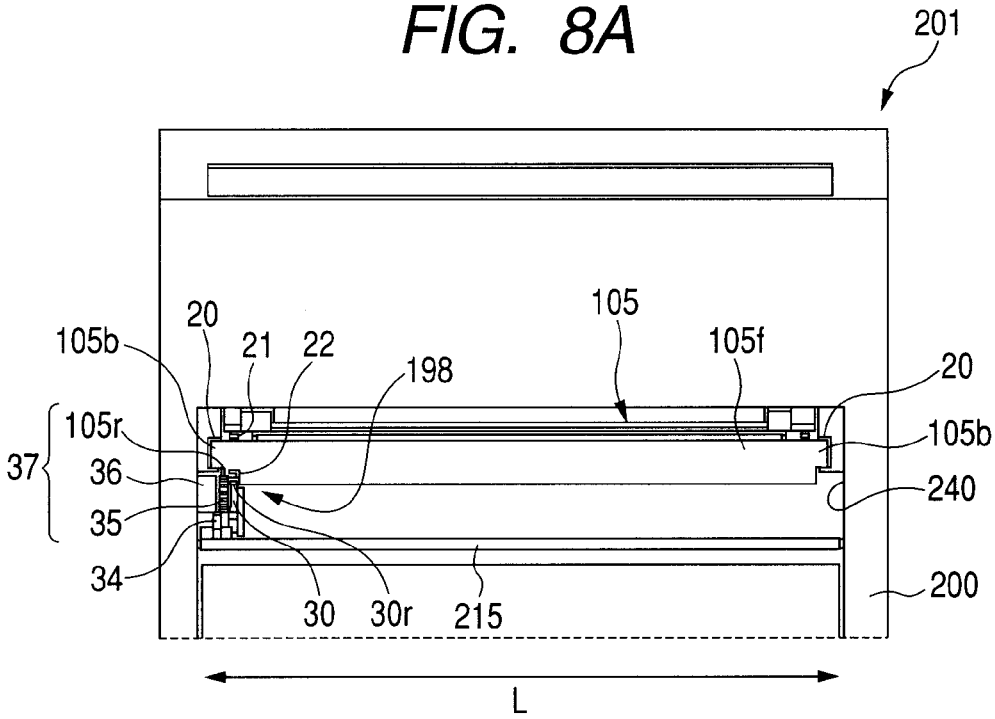
FIGS. 8A and 8B are diagrams illustrating an opening portion of an apparatus main body of the image forming apparatus according to Embodiment 2 of the present invention.
Figure 8B:
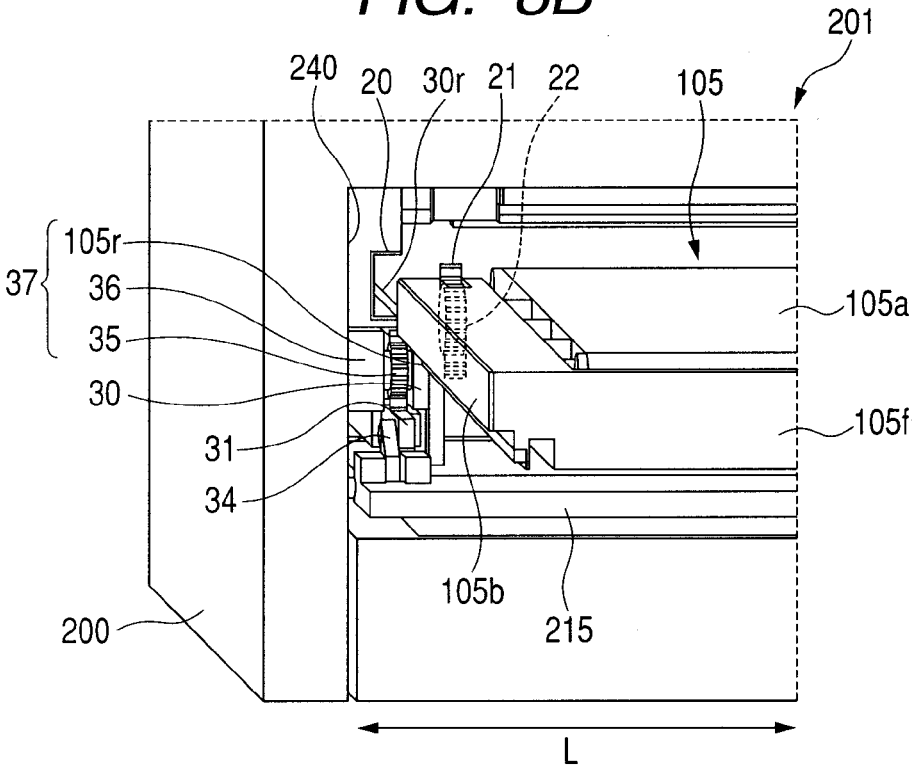

FIGS. 8A and 8B are diagrams illustrating an opening portion 240 of the apparatus main body 200 of the image forming apparatus 201. FIG. 8A is a side view of the image forming apparatus 201. FIG. 8B is a partially enlarged perspective view of the opening portion 240. The transfer means 105 is removably mounted to the apparatus main body 200 through the opening portion 240. The transfer frame 105*f* includes to-be-guided ribs 105*b* at both ends of the axial direction (a direction indicated by the arrow L of FIGS. 8A and 8B) of the roller 71 which is parallel to a longitudinal direction of the drums 1. The to-be-guided ribs 105*b* are extended along the movement route M of the transfer means 105. On the other hand, guide grooves 20 corresponding to the to-be-guided ribs 105*b* are provided in the apparatus main body 200. The to-be-guided ribs 105*b* are inserted into the guide grooves 20, and the transfer means 105 is slidably supported by the guide grooves 20 of the apparatus main body 200 in a substantially horizontal direction (a direction along the movement route M). The transfer means 105 is usually positioned at the mounting position MP within the apparatus main body 200, which is illustrated by a solid line in FIG. 7. When the maintenance or replacement of the transfer means 105 is needed, the transfer means 105 may be removed from the apparatus main body 200 by being pulled out in the substantially horizontal direction (the direction along movement route M) as described later.

Figure 9A:
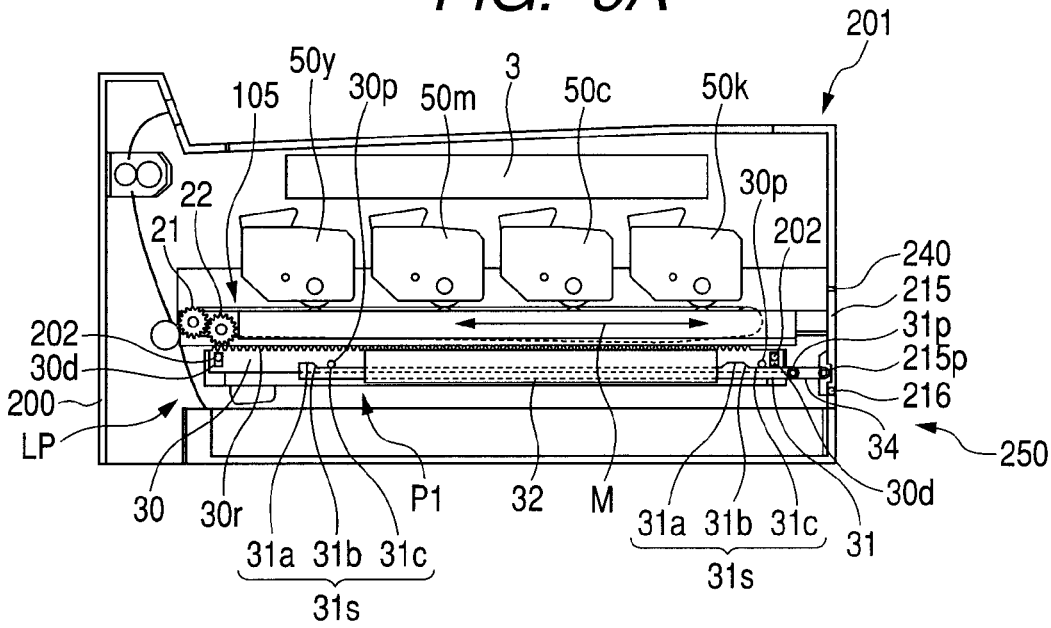
FIGS. 9A and 9B are partially sectional views of the image forming apparatus according to Embodiment 2 of the present invention.
Figure 9B:
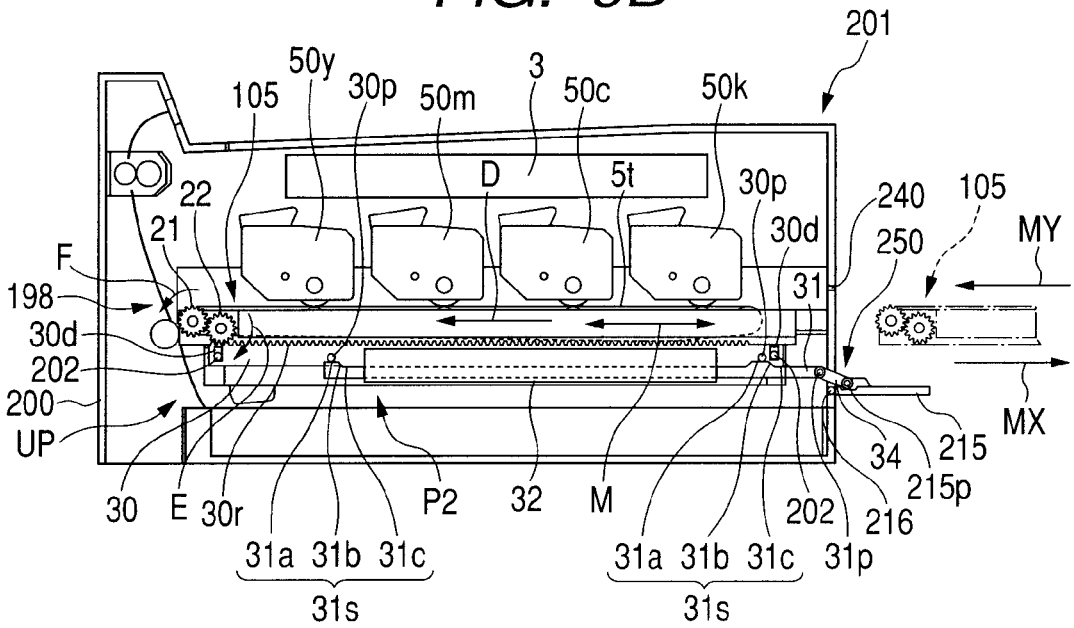

FIGS. 9A and 9B are partially sectional views of the image forming apparatus 201 according to Embodiment 2 of the present invention. FIG. 9A illustrates a state in which the opening portion 240 is closed by a door (an openable and closable member) 215. FIG. 9B illustrates a state in which the door 215 is opened, to thereby open the opening portion 240. The transfer means 105 includes a third driven gear 21 and an intermediate gear 22 on a side on which the roller 71 is provided (upstream in the removing direction MX). The driven gear 21 is connected to the roller 71 so as to rotate integrally with the roller 71. The intermediate gear 22 is rotatably supported by the transfer frame 105, and is meshed with the driven gear 21. On the other hand, a first rack member 30 extending along the movement route M of the transfer means 105 is provided in the apparatus main body 200. The first rack member 30 is disposed at the position at which the first rack member 30 coincides with the intermediate gear 22 in the direction of the axis line 71X of the roller 71 (a direction indicated by the arrow L of FIGS. 8A and 8B), and below the transfer means 105. Both end portions of the first rack member 30 each has a long hole 30*d* extending in a vertical direction. The long holes 30*d* are fitted onto pins 202 provided in the apparatus main body 200. The first rack member 30 is supported by the apparatus main body 200 so as to be vertically movable. On a top surface of the first rack member 30, a first rack tooth (a rack portion) 30*r* is provided. A pair of to-be-guided pins 30*p* are projected from the side surface of the first rack member 30.

(Raising and Lowering Member)

The apparatus main body 200 includes a raising and lowering member 31 disposed in parallel with the first rack member 30. The raising and lowering member 31 extends along the movement route M of the transfer means 105. The raising and lowering member 31 is disposed below the pair of to-be-guided pins 30*p*. The raising and lowering member 31 is supported by a raising and lowering member supporting member 32 so as to be slidable in a substantially horizontal direction along the movement route M. The raising and lowering member 31 includes a pair of guide surfaces 31*s*, which engage with the pair of to-be-guided pins 30*p*, respectively. Each of the pair of guide surfaces 31*s* is a continuous surface including a first horizontal surface 31*a*, a slant surface 31*b*, and a second horizontal surface 31*c*. The first horizontal surface 31*a* is provided above the second horizontal surface 31*c*. The slant surface 31*b* is downwardly slanted from the first horizontal surface 31*a* to the second horizontal surface 31*c*. The pair of guide surfaces 31*s* are engaged with the pair of to-be-guided pins 30*p*, to thereby regulate the vertical position of the first rack member 30 relative to the raising and lowering member 31. The raising and lowering member supporting member 32 is provided between the pair of guide surfaces 31*s*.

When the raising and lowering member 31 is moved in the mounting direction MY to be positioned at a first position P1 as illustrated in FIG. 9A, the first rack member 30 moves downward by its own weight or by an urging member (not shown) so that the to-be-guided pins 30*p* abut the second horizontal surfaces 31*c*. The first rack member 30 is regulated by the second horizontal surfaces 31*c* to be positioned at a lowered position LP. At this time, the first rack tooth 30*r* is separated from the intermediate gear 22.

On the other hand, if the raising and lowering member 31 is moved to the removing direction MX, the slant surfaces 31*b* engage with the to-be-guided pins 30*p* to raise the to-be-guided pins 30*p*, and move the first rack member upward. When the raising and lowering member 31 is further moved in the removing direction MX, the to-be-guided pins 30*p* run on the first horizontal surfaces 31*a*, and the to-be-guided pins 30*p* abut the first horizontal surfaces 31*a*. The first rack member 30 is regulated by the first horizontal surface 31*a* to be positioned at a raised position UP. At this time, the first rack tooth 30*r* engages with the intermediate gear 22.

(Door and Link Mechanism)

The door 215 is rotatably attached to the apparatus main body 200 by a hinge 216. The door 215 is rotated about the hinge 216 to open/close the opening portion 240. The transfer means 105 moves between the mounting position MP and the removing position DP through the opening portion 240. The image forming apparatus 201 includes an interlocking means 250 described below. The interlocking means 250 causes, when the door 215 closes the opening portion 240, the raising and lowering member 31 to position at the lowered position LP, and the door 215 causes, when the opening portion 240 is opened, the raising and lowering member 31 to position at the raised position UP.

The raising and lowering member 31 includes a first pin 31*p* at its end portion on the side of the door 215, namely, on the side of the opening portion 240 (the right-hand side in FIGS. 9A and 9B). To the first pin 31*p*, one end portion of a link member 34 is rotatably attached. The other end portion of the link member 34 is rotatably attached to a second pin 215*p* provided on the door 215. The first pin 31*p*, the link member 34, the second pin 215*p*, the door 215, and the hinge 216 constitute a link mechanism 250 as the interlocking means. As illustrated in FIG. 9A, when the door 215 is in the closed state, the raising and lowering member 31 is positioned at the first position P1 by the link mechanism 250. When the raising and lowering member 31 is positioned at the first position P1, the first rack member 30 is positioned at the lowered position LP. As illustrated in FIG. 9B, when the door 215 is in the opened state, the raising and lowering member 31 is positioned at a second position P2 by the link mechanism 250. When the raising and lowering member 31 is positioned at the second position P2, the first rack member 30 is positioned at the raised position UP. Accordingly, the vertical movement of the first rack member 30 interlocks with the opening/closing operation of the door 215 by the link mechanism 250. When the door 215 is closed, the first rack member 30 is retracted to the lowered position LP, and the first rack tooth 30*r* is separated from the intermediate gear 22. When the door 215 is opened, the first rack member 30 moves to the raised position UP, and the first rack tooth 30*r* is engaged with the intermediate gear 22.

(Rotative Force Generating Means)

The rotative force generating means 198 according to this embodiment will be described hereinbelow. The rotative force generating means 198 (FIG. 9B) generates, when the transfer means 105 is moved from the mounting position MP to the removing position DP in the removing direction MX, a rotative force for rotating the belt 5*a* in association with the movement of the transfer means 105. Further, the rotative force generating means 198 generates a rotative force for rotating the belt 5*a* in association with the movement of the transfer means 105, when the transfer means 105 is moved from the removing position DP to the mounting position MP in a mounting direction MY. The rotative force generating means 198 includes the first rack member 30, an intermediate gear 22, which meshes with the first rack tooth 30*r* of the first rack member 30, the third driven gear (a driven gear) 21 which meshes with the intermediate gear 22, and the raising and lowering member 31. As the rotative force generating means 198 generates the rotative force in association with the movement of the transfer means 105, there is no need to separately provide a driving source for generating a rotative force.

The rotative force generating means 198 generates, when the transfer means 105 is moved from the mounting position MP to the removing position DP in the removing direction MX, a rotative force in association with the movement of the transfer means 105, to thereby rotate the belt 5*a* in one direction. With this, the transfer surface 5*t* of the belt 5*a*, which is in contact with at least one of the plurality of drums 1, is moved in a direction opposite to the removing direction MX with respect to the transfer means 105. Further, the rotative force generating means 198 generates, when the transfer means 105 is moved from the removing position DP to the mounting position MP in the mounting direction MY, in association with the movement of the transfer means 105, a rotative force, to thereby rotate the belt 5*a* in a direction opposite to the one direction. With this, the transfer surface 5*t* of the belt 5*a* is moved in a direction opposite to the mounting direction MY with respect to the transfer means 105. Accordingly, it is possible to prevent a scratch from being marked on the surfaces of the drums 1 or the surface of the belt 5*a* by reducing a relative speed at a contact area between the drum 1 and the belt 5*a*.

When the transfer means 105 is moved from the mounting position MP to the removing position DP, the relative speed between the drum and the belt 5*a* becomes zero at a position at which at least one of the plurality of drums 1 is in contact with the belt 5*a*. When the transfer means 105 is moved from the removing position DP to the mounting position MP, the relative speed between the drum and the belt 5*a* becomes zero at a position at which at least one of the plurality of drums 1 is in contact with the belt 5*a*. With this structure, even if the belt 5*a* is in contact with the drums 1, it is possible to prevent a scratch from being marked on the surfaces of the drums 1 or the surface of the belt 5*a* because of the reduction in rubbing of the belt 5*a* against the drums 1.

The above-mentioned rotative force generating means 198 of this embodiment includes the rack portion 30, which extends along the movement route M of the transfer means 105, which moves between the mounting position MP and the removing position DP. The rotative force generating means 198 includes the driven gear 21, which integrally rotates with the rotation shaft 71*a* of the roller 71, and the intermediate gear 22 which meshes with the driven gear 21. The rotative force generating means 198 includes the raising and lowering member 31, which raises the rack portion 30 to the raised position UP at which the rack portion 30 is meshed with the intermediate gear 22, and lowers the rack portion 30 to the lowered position LP at which the rack portion 30 is separated from the intermediate gear 22.

At the time of the maintenance or replacement of the transfer means 105, the user opens the door 215, and performs the removal and mounting of the transfer means 105. When the door 215 is opened, the first rack member 30 is moved to the raised position UP by the link mechanism 250 so that the first rack tooth 30*r* falls into a state of being engaged with the intermediate gear 22. The belt 5*a* of the transfer means 105 is in contact with the drums 1. When the transfer means 105 is removed from the apparatus main body 200, the user pulls out the transfer means 105 in the removing direction MX. If the transfer means 105 is moved in the removing direction MX in a state in which the first rack tooth 30*r* is engaged with the intermediate gear 22, the intermediate gear 22 is rotated by the first rack tooth 30*r* in a clockwise direction indicated by an arrow E in FIG. 9B. The intermediate gear 22 rotates the third driven gear 21 in a counterclockwise direction indicated by an arrow F. The third driven gear (a driven gear) 21 rotates the roller 71 and the belt 5*a* in the counterclockwise direction. At this time, the movement direction D of the belt 5*a* on the side of the primary transfer surface 5*t* becomes the opposite direction to the removing direction MX of the transfer means 105. With this, the relative speed at the contact area between the drum 1 and the belt 5*a* is made smaller, thereby being capable of preventing a scratch from being marked on the surfaces of the drums 1 or the surface of the belt 5*a*. Further, as in Embodiment 1, the reference pitch circle radius R1 of the driven gear 21 is set so as to have the same value as a value obtained by adding a thickness "t" of the belt 5*a* to an outer peripheral surface radius R2 of the rubber layer 71*b* of the roller 71. Therefore, on the side of the primary transfer surface 5*t*, the belt 5*a* moves in the direction D which is opposite to the removing direction MX of the transfer means 105 at the same magnitude of speed as the pull-out speed of the transfer means 105. With this operation, the relative speed, when the transfer means 105 is pulled out, at the contact areas between the drums 1 and the belt 5*a* become substantially zero. In other words, at the contact areas between the belt 5*a* and the drums 1, the belt 5*a* does not relatively move with respect to the drums 1. Accordingly, even if the belt 5*a* is in contact with the drums 1, it is possible to prevent a scratch from being marked on the surfaces of the drums 1 or the surface of the belt 5*a* because of the reduction in rubbing of the belt 5*a* against the drums 1. As the transfer means 105 may be moved while the belt 5*a* is in contact with the drums 1, the transfer means 105 may be removed from the apparatus main body 200 by only moving the transfer means 105 in one direction from the mounting position MP. Accordingly, the operation at the time of removing the transfer means 105 is facilitated.

When the transfer means 105 is further moved in the removing direction MX, the engagement between the intermediate gear 22 and the first rack member 30 is released, and the transfer means 105 reaches the removing position DP. The transfer means 105 is removed from the apparatus main body 200, at the removing position DP, by removing to-be-guided ribs 105*b* provided on the transfer means 105 from the guide grooves 20 formed in the apparatus main body 200 (FIG. 8B).

When the transfer means 105 is mounted to the apparatus main body 100, a reverse operation to the above-mentioned removing operation is performed. The user engages, at the removing position DP, the to-be-guided ribs 105*b* provided on the transfer means 105 with the guide grooves 20 provided to the apparatus main body 200 (FIG. 8B). If the transfer means 5 is pushed in the mounting direction indicated by an arrow MY in FIG. 9B, the intermediate gear 22 engages with the first rack tooth 30*r*. In association with the movement of the transfer means 105 in the mounting direction MY along the movement route M, the intermediate gear 22 is rotated in a direction opposite to a direction indicated by an arrow E by the first rack tooth 30*r* of the first rack member 60. The third to-be-driven gear 21 is rotated in the direction opposite to the direction indicated by an arrow F through the rotation of the intermediate gear 22. The third to-be-driven gear 21 rotates the roller 71 and the belt 5*a* in a clockwise direction. At this time, a movement direction (opposite to the direction indicated by the arrow D) of the belt 5*a* on the side of the primary transfer surface 5*t* becomes the opposite direction to the mounting direction MY of the transfer means 105. With this, the relative speed at the contact areas between the drums 1 and the belt 5*a* is made smaller, thereby being capable of preventing a scratch from being marked on the surfaces of the drums 1 or the surface of the belt 5*a*. On the side of the primary transfer surface 5*t*, the belt 5*a* moves in the direction opposite to the mounting direction MY of the transfer means 105 at the same magnitude of speed as the push-in speed of the transfer means 105. With this, the relative speed between the drums 1 and the primary transfer surface 5*t* of the belt 5*a* at the time of mounting the transfer means 105 becomes substantially zero. In other words, at the contact areas between the belt 5*a* and the drums 1, the belt 5*a* does not relatively move with respect to the drums 1. Accordingly, even if the belt 5*a* is in contact with the drums 1, it is possible to prevent a scratch from being marked on the surfaces of the drums 1 or the surface of the belt 5*a* because of the reduction in rubbing of the belt 5*a* against the drums 1. As the transfer means 105 can be moved while the belt 5*a* is in contact with the drums 1, the transfer means 105 can be mounted to the apparatus main body 200 by only moving the transfer means 105 from the removing position DP in the mounting direction MY. Accordingly, the operation at the time of mounting the transfer means 5 is facilitated.

The user closes the door 215 after mounting the transfer means 105 to the mounting position MP. When the door 215 is closed, the first rack member 30 is moved to the lowered position LP by the link mechanism 250 so that the first rack tooth 30*r* is separated from the intermediate gear 22. Accordingly, the roller 70 may be rotated by a motor (not shown) to rotate the belt 5*a* for image formation.

(Resistance Giving Unit)

If the user abruptly pulls out or pushes in the transfer means 105, there is a fear in that the roller 71 may rotate while slipping on the belt 5*a*. To prevent the slippage between the roller 71 and the belt 5*a*, the image forming apparatus 201 of this embodiment is provided with a resistance giving means (hereinafter referred to as a resistance giving unit) 37 (FIGS. 8A and 8B). The resistance giving unit 37 gives a resistance force (a braking force) to the transfer means 105 to put a brake on the movement of the transfer means 105, which is moved from the mounting position to the removing position in the removing direction MX, and on the movement of the transfer means 105, which is moved from the removing position to the mounting position in the mounting direction MY.

Figure 10A:
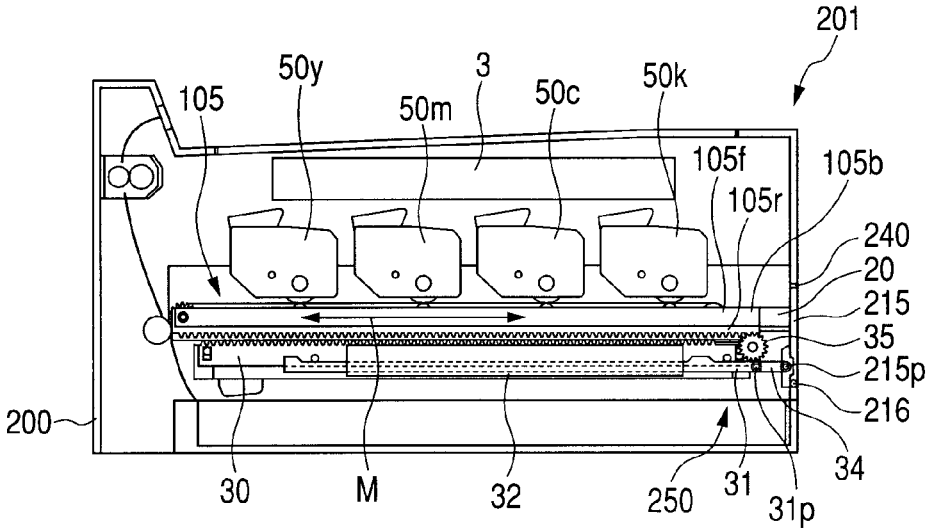
FIGS. 10A and 10B are partially sectional views of the image forming apparatus according to Embodiment 2 of the present invention.
Figure 10B:
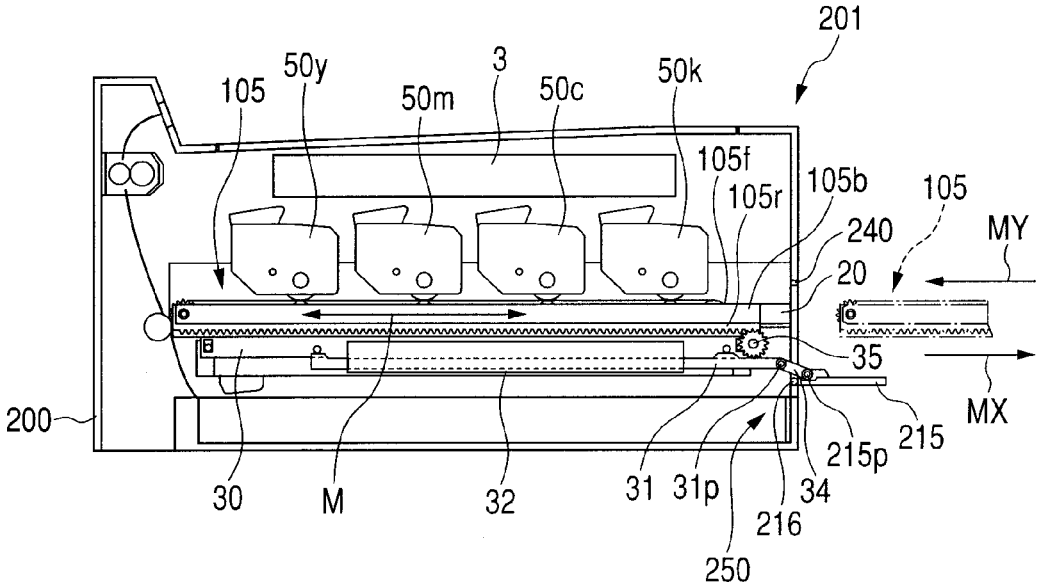

As illustrated in FIGS. 10A and 10B, a second rack tooth 105*r* extending along the movement route M is provided on the lower portion of the transfer frame 105*f*. The apparatus main body 200 includes a rotary damper 36 provided with a damper gear (a gear to which the rotation resistance force is given) 35 (FIGS. 8A and 8B). The resistance giving unit 37 includes the second rack tooth 105*r*, a damper gear 35, and the rotary damper 36. The rotary damper 36 is fixed in the vicinity of the door 215 within the apparatus main body 200. The damper gear 35 is fixed to the rotation shaft of the rotary damper 36. The rotary damper 36 gives a rotation resistance force to the damper gear 35. The damper gear 35 is disposed at a position at which the damper gear 35 engages with the second rack tooth 105*r* when the transfer means 105 is pulled out in the removing direction MX for removing the transfer means 105 from the apparatus main body 200, and the transfer means 105 is pushed in the mounting direction MY for mounting the transfer means 105 to the apparatus main body 200. The length of the second rack tooth 105*r* and the position of the damper gear in the movement route M of the transfer means 105 is set so that, in a state in which the belt 5*a* is in contact with at least any one of the drums 1, the second rack tooth 105*r* engages with the damper gear 35. The rotary damper 36 acts as a braking unit for reducing a speed of, or stopping the slide movement of the transfer means 105. When the user pulls out and pushes in the transfer means 105, rotation torque of the rotary damper 36 reduces the movement speed of the transfer means 105. With this structure, the slippage of the roller 71 relative to the belt 5*a* due to the abrupt operation of the transfer means 105 is prevented.

Embodiment 3

Hereinafter, a description will be provided of Embodiment 3 of the present invention with reference to FIG. 11 to FIGS. 15A and 15B. In the description of Embodiment 3, the same structures as in Embodiment 1 are denoted by the same reference symbols, and the description thereof is omitted. Further, a process cartridge and an image forming process of Embodiment 3 are the same as in Embodiment 1, and hence the description thereof is omitted.

(Image Forming Apparatus)

Figure 11:
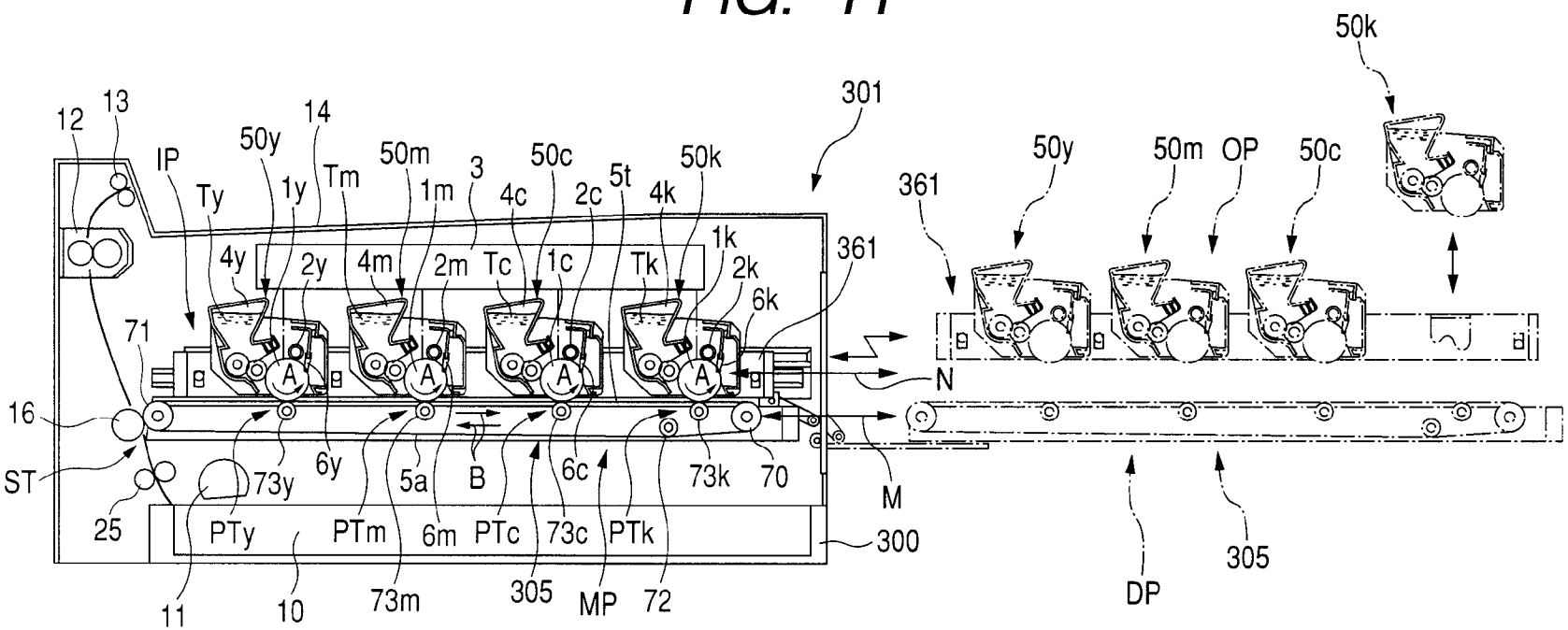
FIG. 11 is a sectional view illustrating an image forming apparatus according to Embodiment 3 of the present invention.

FIG. 11 is a sectional view of an image forming apparatus 301 according to Embodiment 3 of the present invention. In the image forming apparatus 301 of Embodiment 3, in addition to an intermediate transfer means 305, a process cartridge supporting member 361 is removably mounted to an apparatus main body 300. Four process cartridges 50 (50*y*, 50*m*, 50*c*, 50*k*) are removably supported by the supporting member 361. The process cartridges 50 are the same as the process cartridges of Embodiment 1 illustrated in FIGS. 3A and 3B. Therefore, a description of the process cartridges 50 is omitted. The supporting member 361 is linearly movable, in a state of supporting the plurality of cartridges 50, between an inside position IP positioned inside the apparatus main body 300 and an outside position OP positioned outside the apparatus main body 300.

(Apparatus Main Body)

Figure 12:
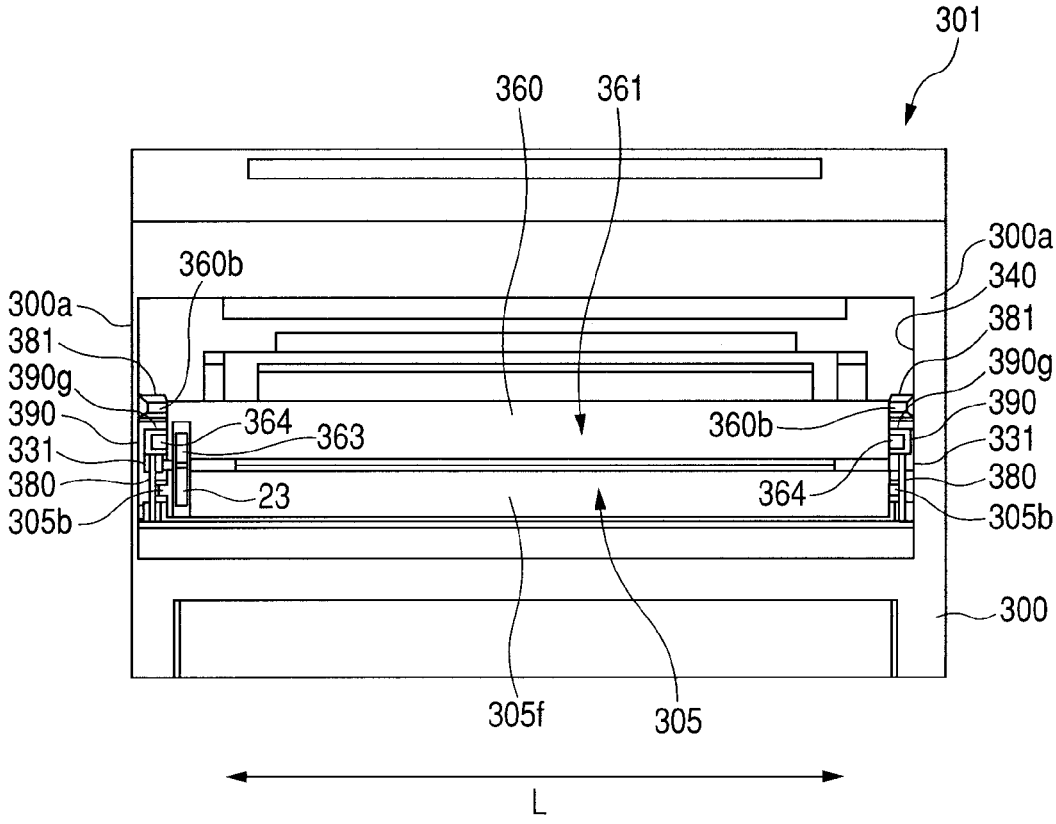
FIG. 12 is a diagram illustrating an opening portion of an apparatus main body of the image forming apparatus according to Embodiment 3 of the present invention.

FIG. 12 is a diagram illustrating an opening portion 340 of the apparatus main body 300 of the image forming apparatus 301. The transfer means 305 is removably mounted to the apparatus main body 300 through the opening portion 340. On the inner sides of both side portions 300*a* of the apparatus main body 300, there are formed the transfer guide grooves 380 for guiding the to-be-guided ribs 305*b* at both ends of the transfer frame 305*f* of the transfer means 305. The transfer guide grooves 380 are extended along the movement route M (FIG. 11) of the transfer means 305. The to-be-guided ribs 305*b* of the transfer means 305 are inserted into the transfer guide grooves 380, and the transfer means 305 is slidably supported by the transfer guide grooves 380 of the apparatus main body 300 in a substantially horizontal direction (the direction along the movement route M). The transfer means 305 is usually positioned at the mounting position MP within the apparatus main body 300, which is illustrated by a solid line in FIG. 11. When the maintenance or replacement of the transfer means 305 is needed, the transfer means 305 is pulled out in the substantially horizontal direction (the direction along the movement route M) as described later so as to be removed from the apparatus main body 300.

The supporting member 361 is removably mounted to the apparatus main body 300 through the opening portion 340. On the inner sides of both side portions 300*a* of the apparatus main body 300, there are provided supporting member guide grooves 381 for guiding the to-be-guided ribs 360*b* of both side portions of a supporting frame member 360 of the supporting member 361. The supporting member guide grooves 381 extend along the movement route N (FIG. 11) of the supporting member 361. The to-be-guided ribs 360*b* of the supporting member 361 are inserted into the supporting member guide grooves 381, and the supporting member 361 is slidably supported by the supporting member guide grooves 381 of the apparatus main body 300 in a substantially horizontal direction (the direction along the movement route N). The supporting member 361 is, usually, positioned at the inside position IP inside the apparatus main body 300 illustrated by a solid line in FIG. 11. When replacing the process cartridges 50, the supporting member 361 is pulled out from the apparatus main body 300, thereby being capable of positioning the supporting member 361 at an outside position OP outside the apparatus main body 300.

Figure 13A:
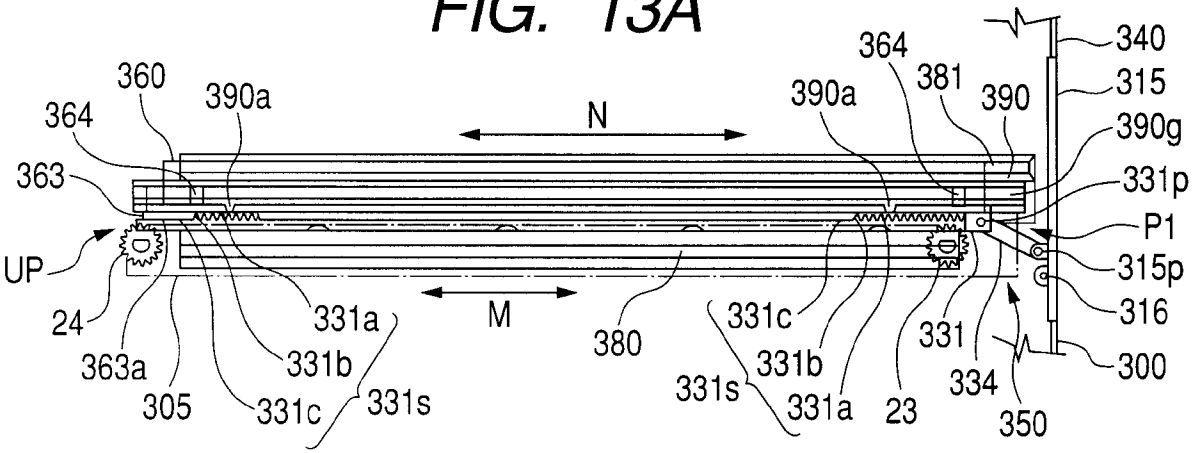
FIGS. 13A and 13B are diagrams illustrating a rack member holding shaft guiding member and a raising and lowering member according to Embodiment 3 of the present invention.
Figure 13B:
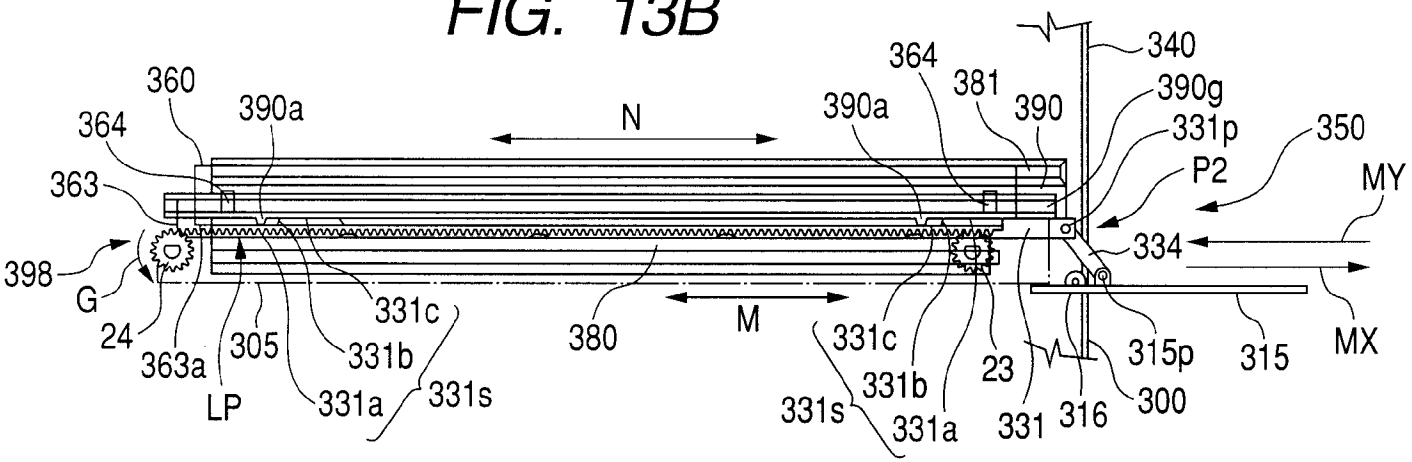

A pair of rack member holding shaft guiding members 390 are provided on the inner sides of the both side portions 300*a* of the apparatus main body 300, respectively. The guiding members 390 is movably supported in a substantially vertical direction relative to the apparatus main body 300 by a guide structure member (not shown) provided in the apparatus main body 300. The vertical movement of the guiding members 390 moves a rack member 363 described below between the raised position UP and the lowered position LP. As illustrated in FIGS. 13A and 13B, the guiding members 390 include the rack member holding shaft guide grooves 390*g*, which engage with rack member holding shafts 364 of the rack member 363 described later. The holding shaft guide grooves 390*g* extend along the movement route N of the supporting member 361 in parallel with the supporting member guide grooves 381 in a substantially horizontal direction. Each of the guiding members 390 includes a pair of protruding portions 390*a* at the bottom surface thereof.

On the inner sides of the both side portions 300*a* of the apparatus main body 300, there are provided a pair of raising and lowering members 331. The raising and lowering members 331 are supported by the guide structure member (not shown) provided to the apparatus main body 300 so as to be movable with respect to the apparatus main body 300 in the substantially horizontal direction. As illustrated in FIGS. 13A and 13B, the raising and lowering members 331 are movable in the substantially horizontal direction along the movement route N of the supporting member 361 while being in contact with the protruding portions 390*a* of the guiding members 390.

(Transfer Means)

Figure 14A:
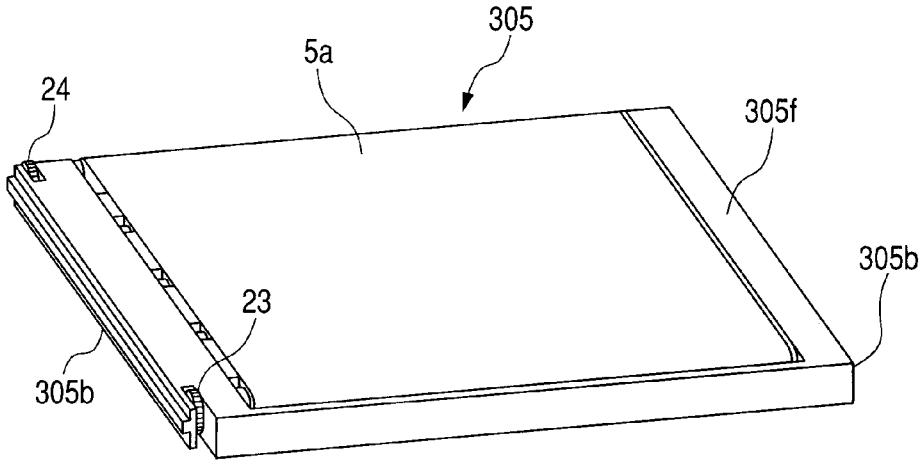
FIGS. 14A, 14B, and 14C are diagrams illustrating a transfer means according to Embodiment 3 of the present invention.
Figure 14B:
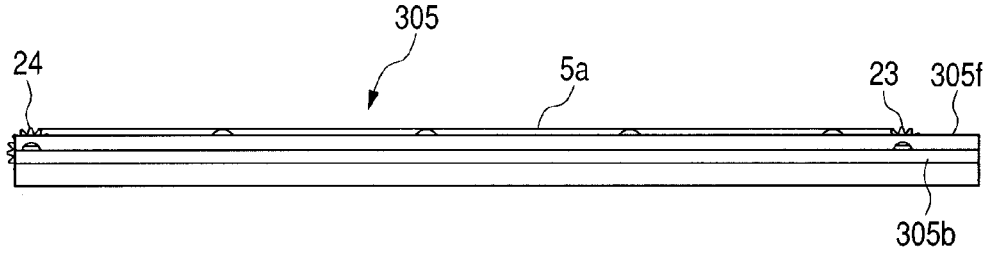
Figure 14C:
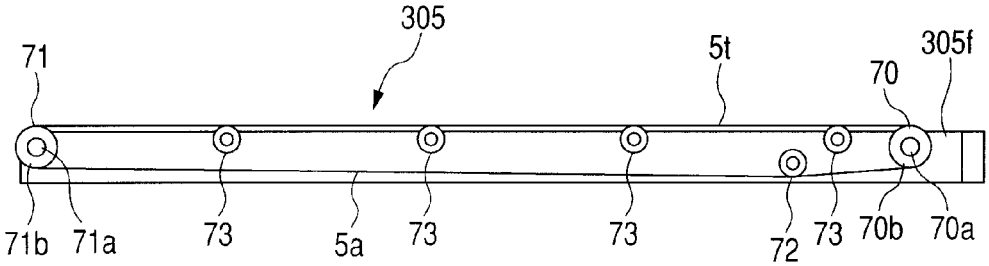

FIGS. 14A to 14C illustrate a transfer means 305 of Embodiment 3. FIG. 14A is a perspective view of the transfer means 305. FIG. 14B is a front view of the transfer means 305. FIG. 14C is a sectional view of the transfer means 305.

The transfer means transfers the toner images formed on the drums 1 onto a recording medium or an intermediate transfer member. The transfer means 305 of Embodiment 3 rotatably supports a transfer member (hereinafter referred to as a belt) 5*a* for transferring the toner images formed on a plurality of drums 1*y*, 1*m*, 1*c*, and 1*k* onto a recording medium. The transfer means 305 is linearly movable between a mounting position MP inside the apparatus main body 300 at which the transfer means 305 is mounted to the apparatus main body 300 and a removing position DP outside the apparatus main body 300 at which the transfer means 305 is removed from the apparatus main body 300. In this Embodiment, the transfer means 305 includes a transfer belt 5*a*, a first suspension roller 70, a second suspension roller 71, a tension roller 72, a primary transfer roller 73, and a transfer frame (an intermediate transfer member supporting member) 305*f*. However, the transfer means 305 is not limited thereto. The transfer means 305 may be the one as long as which rotatably supports the belt 5*a*. The first suspension roller 70, the second suspension roller 71, and the primary transfer rollers 73 are disposed substantially in parallel with the arrangement direction of the plurality of drums 1, and are rotatably supported by the transfer frame 305*f*. The belt 5*a* is suspended so that a portion of the belt 5 between the roller 70 and the roller 71 forms a primary transfer surface 5*t*, which is a substantially flat surface. As illustrated in FIG. 11, when the transfer means 305 is mounted at the mounting position MP of the apparatus main body 300, the primary transfer surface 5*t* of the transfer belt 5*a* are in contact with the respective drums 1. The first suspension roller (a first rotary member) 70 is disposed on a downstream side of the transfer means 305 in the removing direction. The second suspension roller (s second rotary member) 71 is disposed on an upstream side of the transfer means 305 in the removing direction. A rotative force generating means 398 described later generates a rotative force for rotating the roller 71 disposed on an upstream side of a removing direction MX. Accordingly, the rotative force generating means 398 can generate the rotative force until the transfer means 305 reaches the removing position DP. The transfer means 305 is an intermediate transfer member cartridge in which the belt 5*a*, the roller 70, the roller 71, the tension roller 72, and the primary transfer rollers 73 are integrally incorporated into the transfer frame 305*f*. The transfer means (the intermediate transfer member cartridge) 305 is removably mounted to the apparatus main body 300 of the image forming apparatus 301.

The roller 71 includes, as in Embodiment 1, the rotation shaft 71*a* and the rubber layer 71*b* provided on the shaft 71*a*. In Embodiment 3, similarly to the roller 71, the roller 70 also includes the rotation shaft 70*a* and the rubber layer 70*b* provided on the rotation shaft 70*a*.

The transfer frame 305*f* includes to-be-guided ribs 305*b* at both end portions of the roller 71 in its axial direction (indicated by the arrow L of FIG. 12), which is in parallel with the longitudinal direction of the drums 1. The to-be-guided ribs 305*b* are inserted into transfer guide grooves 380 of the apparatus main body 300, and the transfer means 305 is slidably held in a substantially horizontal direction of the apparatus main body 300. The transfer means 305 includes the first gear 23 and the second gear 24. The first gear 23 is coupled to the shaft 70*a* of the roller 70 to be integrally rotated with the roller 70. The second gear 24 is coupled to the shaft 71*a* of the roller 71 to be integrally rotated with the roller 71. The outer peripheral surface radius R2 of the rubber layer 70*b* of the roller 70 and the outer peripheral surface radius R2 of the rubber layer 71 of the roller 71 are substantially the same. The gear 23 and the gear 24 have the same gear specification with each other. The reference pitch circle radius R1 of the gear 23 and the gear 24 is set so as to have the same value as a value obtained by adding a thickness "t" of the belt 5*a* to an outer peripheral surface radius R2 of the rubber layer 70*b* or the rubber layer 71*b*.

The belt 5*a* of this embodiment is an intermediate transfer belt, onto which the toner images formed on the plurality of drums 1 are primarily transferred and superimposed, and from which the superimposed toner images are secondarily transferred onto a recording medium. However, the present invention is not limited thereto. The belt 5*a* may be a transfer belt, which conveys a recording medium onto which the toner images formed on the plurality of drums 1 are transferred.

(Process Cartridge Supporting Member)

Figure 15A:
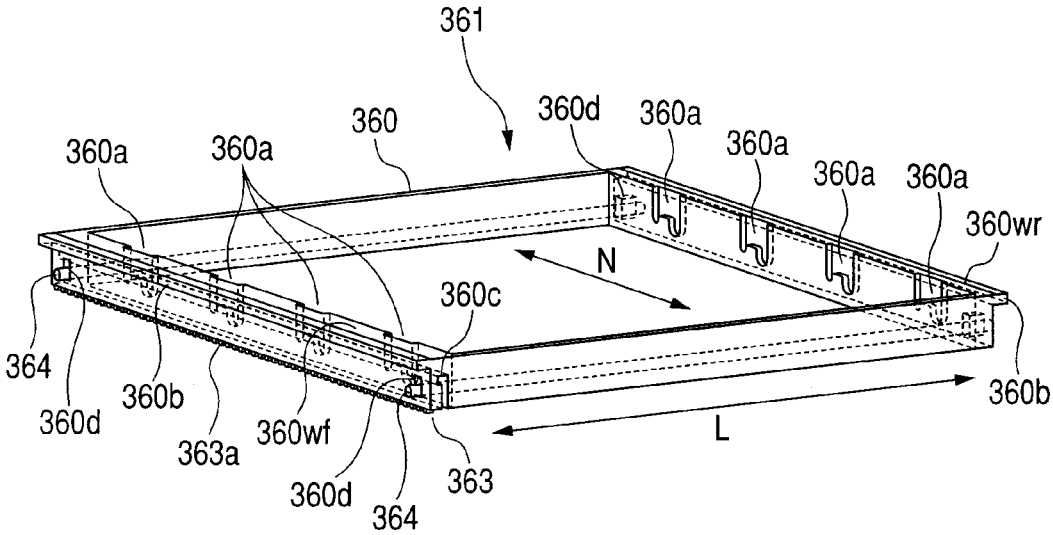
FIGS. 15A and 15B are diagrams illustrating a process cartridge supporting member according to Embodiment 3 of the present invention.
Figure 15B:
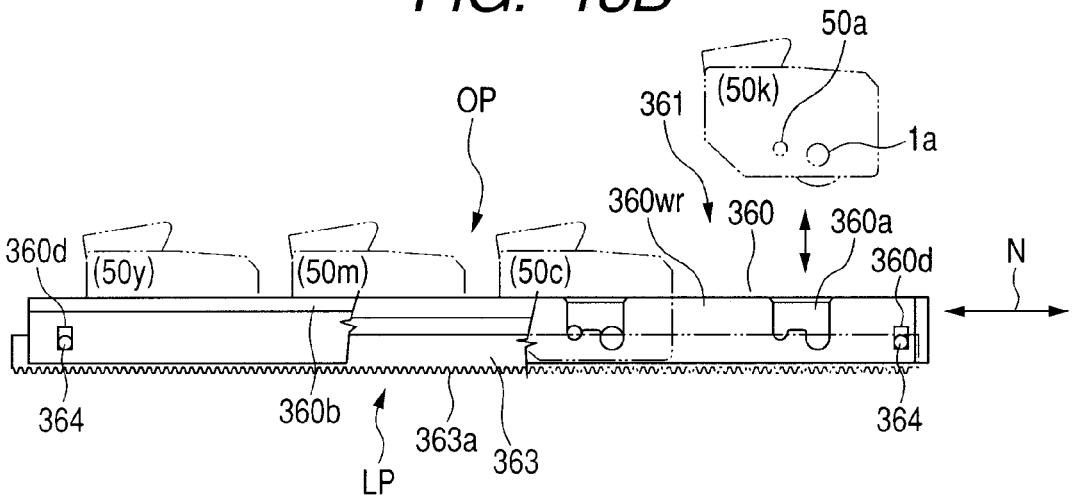

FIGS. 15A and 15B illustrate a process cartridge supporting member 361 according to Embodiment 3 of the present invention. FIG. 15A is a perspective view of the supporting member 361. FIG. 15B is a partially sectional view of the supporting member 361. The supporting member 361 is linearly movable, in a state of supporting the plurality of cartridges 50, between an inside position IP positioned inside the apparatus main body 300 and an outside position OP positioned outside the apparatus main body 100.

As illustrated in FIG. 15A, the supporting member 361 includes the supporting frame member 360 having a rectangular shape. On the inner sides of both side portions 360*wf* and 360*wr* of the supporting frame member 360 in the direction indicated by the arrow L, there are provided the guide portions 360*a* for removably mounting the cartridges 50. On tops outside the both side portions 360*wf* and 360*wr* of the supporting frame member 360, the to-be-guided ribs 360*b* are provided. The to-be-guided ribs 360*b* are extended in a direction along the movement route N of the supporting member 361, which is perpendicular to the direction indicated by the arrow L. On one side portion 360*wf* of the supporting frame member 360, a receiving groove 360*c* for receiving the rack member 363 is formed. The receiving groove 360*c* extends in a direction along the movement route N of the supporting member 361, and is opened downward. Long holes 360*d* are formed in the vicinities of the both end portions of the side portions 360*wf* and 360*wr* in the direction along the movement route N of the supporting member 361. The long holes 360*d* extend in the vertical direction. The long holes 360*d* extends through the supporting frame member 360 below the to-be-guided ribs 360*b*.

The rack member 363 includes a rack portion 363*a*. The rack member 363 is inserted into the receiving groove 360*c* so that the lack portion 363*a* faces downward. The rack member 363 is vertically movable within the receiving groove 360*c*. In the vicinities of the both end portions of the rack member 363 in the direction along the movement route N of the supporting member 361, holes (not shown) are formed at positions corresponding to the long holes 360*d* of the supporting frame member 360, respectively.

Each of the pair of the holding shafts 364 extends, in a state in which the rack member 363 is received in the receiving grooves 360*c*, through the long holes 360*d* of the supporting frame member 360 and the hole (not shown) of the rack member 363. The holding shafts 364 are fixed to the rack member 363 by means of press fitting, bonding, setting screws (not shown), or the like. In a state in which the holding shafts 364 are assembled to the supporting frame member 360, the both end portions of the holding shafts 364 are projected from the outer surfaces of the both side portions 360*wf* and 360*wr* of the supporting frame member 360. The holding shafts 364 are vertically movable within the long hole 360*d*. The rack member 363 is constructed to be vertically movable integrally with the holding shafts 364 relative to the supporting frame member 360. The rack member 363 is urged downward by an urging means (not shown). The both end portions of the holding shafts 364 are inserted into the holding shaft guide grooves 390*g*.

As illustrated in FIG. 15B, when the supporting member 361 is positioned at an outside position OP, the process cartridges 50 (50*y*, 50*m*, 50*c*, 50*k*) are removably mounted to the supporting member 361 from upward. The drum shafts 1*a* and the positioning bosses 50*a* of the cartridges 50 are positioned at the guide portions 360*a*.

(Raising and Lowering Member)

FIGS. 13A and 13B illustrate the rack member holding shaft guiding member 390 and the raising and lowering member 331 of Embodiment 3. The raising and lowering member 331 is disposed below the guiding members 390, and is slidably held by the apparatus main body 300 along the movement route M of the supporting member 361 in a substantially horizontal direction. The raising and lowering member 331 has a pair of guide surfaces 331*s* each engage with the pair of protruding portions 390*a* of the guiding members 390. Each of the pair of the guide surfaces 331*s* is a continuous surface including a first horizontal surface 331*a*, a slant surface 331*b*, and a second horizontal surface 331*c*. The first horizontal surface 331*a* is provided above the second horizontal surface 331*c*. The slant surface 331*b* downwardly slanted from the first horizontal surface 331*a* to the second horizontal surface 331*c*. The pair of guiding surfaces 331*s* are engaged with the pair of protruding portions 390*a*, to thereby regulate the position of the guiding members 390 in a vertical direction with respect to the raising and lowering member 331.

When the raising and lowering member 331 is moved in the mounting direction MY to be positioned at a first position P1 as illustrated in FIG. 13A, the protruding portions 390*a* of the guiding member 390 abut the first horizontal surfaces 331*a*. The guiding member 390 is regulated to a raised position UP by the first horizontal surfaces 331*a*. As the holding shafts 364 are inserted into the guide grooves 390*g* of the guiding members 390, the holding shafts 364 are held at the raised position. The rack member 363, which is fixed to the holding shaft 364, is also held at the raised position. At this time, the rack portion 363*a* is separated from the first gear 23 and the second gear 24 of the transfer means 305.

On the other hand, if the raising and lowering member 331 is moved in the removing direction MX, the protruding portions 390*a* is lowered along the slant surface 331*b* to abut the second horizontal surface 331*c*. The guiding member 390 is urged downward by its self-weight, or by an urging member (not shown), and hence the protruding portion 390*a* is regulated to the lowered position LP. As a holding shaft 364 engaged with the guiding member 390 is held at the lowered position, the rack member 363, which is fixed to the holding shaft 364, is also held at the lowered position. At this time, the rack portion 363*a* engages with the first gear 23 and the second gear 24.

(Door and Link Mechanism)

The door 315 is rotatably attached to the apparatus main body 300 by a hinge 316. The door 315 is rotated about the hinge 316 to open/close the opening portion 340. The raising and lowering member 331 includes a first pin 331*p* at its end portion on the side of the door 315, namely, on the side of the opening portion 340 (on the right-hand side in FIGS. 13A and 13B). To the first pin 331*p*, one end portion of a link member 334 is rotatably attached. The other end portion of the link member 334 is rotatably attached to a second pin 315*p* provided on the door 315. The first pin 331*p*, the link member 334, the second pin 315*p*, the door 315, and the hinge 316 constitute a link mechanism 350 as the interlocking means. When the door 315 is opened, the raising and lowering member 331 is moved to a second position P2 in the front part through the link mechanism 350 in association with the opening operation of the door 315. When the door 315 is closed, the raising and lowering member 331 is moved to a first position P1 in the inner part through the link mechanism 350 in association with the closing operation. As illustrated in FIG. 13A, when the door 315 is in the closed state, the raising and lowering member 331 is positioned at the first position P1 by the link mechanism 350. When the raising and lowering member 331 is positioned at the first position P1, the rack member 363 is positioned at the raised position UP. As illustrated in FIG. 13B, when the door 315 is in the opening state, the raising and lowering member 331 is positioned at the second position P2 by the link mechanism 350. When the raising and lowering member 331 is positioned at the second position P2, the rack member 363 is positioned at the lowered position LP. Accordingly, the vertical movement of the rack member 363 interlocks with the opening/closing operation of the door 315 through the link mechanism 350. When the door 315 is closed, the rack member 363 is retracted to the raised position UP so that the rack portion 363*a* is separated from the first gear 23 and the second gear 24. When the door 315 is opened, the rack member 363 is moved to the lowered position LP so that the rack portion 363*a* engages with the first gear 23 and the second gear 24.

(Rotative Force Generating Means)

The rotative force generating means 398 according to this embodiment will be described hereinbelow. The rotative force generating means 398 (FIG. 13B) generates a rotative force for rotating the belt 5*a* in association with the movement of the transfer means 305 when the transfer means 305 is moved from the mounting position MP to the removing position DP in the removing direction MX. Further, the rotative force generating means 398 generates a rotative force for rotating the belt 5*a* in association with the movement of the transfer means 305 when the transfer means 305 is moved from the removing position DP to the mounting position MP in the mounting direction MY. The rotative force generating means 398 includes the rack member 363, the first gear 23 and the second gear 24 which mesh with the rack portion 363*a* of the rack member 363, and the raising and lowering member 331. As the rotative force generating means 398 generates the rotative force in association with the movement of the transfer means 305, there is no need to separately provide a driving source for generating a rotative force.

The rotative force generating means 398 generates, when the transfer means 305 is moved from the mounting position MP to the removing position DP in the removing direction MX, a rotative force in association with the movement of the transfer means 105, to thereby rotate the belt 5*a* in one direction. With this operation, the transfer surface 5*t* of the belt 5*a*, which is in contact with at least one of the plurality of drums 1, is moved in a direction opposite to the removing direction MX with respect to the transfer means 305. Further, the rotative force generating means 398 generates, when the transfer means 305 is moved from the removing position DP to the mounting position MP in the mounting direction MY, a rotative force in association with the movement of the transfer means 305, to thereby rotate the belt 5*a* in a direction opposite to the one direction. With this operation, the transfer surface 5*t* of the belt 5*a* is moved in a direction opposite to the mounting direction MY with respect to the transfer means 305. Accordingly, it is possible to prevent a scratch from being marked on the surfaces of the drums 1 or the surface of the belt 5*a* by reducing a relative speed at contact areas between the drums 1 and the belt 5*a*.

When the transfer means 305 is moved from the mounting position MP to the removing position DP, the relative speed between the drum and the belt 5*a* becomes zero at a position at which at least one of the plurality of drums 1 is in contact with the belt 5*a*. When the transfer means 305 is moved from the removing position DP to the mounting position MP, the relative speed between the drum and the belt 5*a* becomes zero at a position at which at least one of the plurality of drums 1 is in contact with the belt 5*a*. With this structure, even if the belt 5*a* is in contact with the drums 1, it is possible to prevent a scratch from being marked on the surfaces of the drums 1 or the surface of the belt 5*a* because of the reduction in rubbing of the belt 5*a* against the drums 1.

In addition, the rotative force generating means 398 of this embodiment generates, when the supporting member 361 is moved from the inside position IP to the outside position OP in the removing direction, a rotative force for rotating the belt 5*a* in association with the movement of the supporting member 361. Further, the rotative force generating means 398 generates, when the supporting member 361 is moved from the outside position OP to the inside position IP in the mounting direction, a rotative force for rotating the belt 5*a* in association with the movement of the supporting member 361. As the rotative force generating means 398 generates the rotative force in association with the movement of the supporting member 361, there is no need to separately provide a driving source for generating a rotative force.

The rotative force generating means 398 generates a rotative force for rotating the roller 71 disposed upstream in the removing direction MX in association with the movement of the transfer means 305. Accordingly, the rotative force generating means 398 may generate the rotative force until the transfer means 305 reaches the removing position DP. The rotative force generating means 398 generates a rotative force for rotating the roller 70 disposed downstream in the removing direction MX in association with the movement of the supporting member 316. Accordingly, the rotative force generating means 398 may generate the rotative force until the supporting member 316 reaches the inside position IP.

(Mount and Removal Operation of Transfer Means)

At the time of the maintenance or replacement of the transfer means 305, the user opens the door 315, and performs the removal and mounting of the transfer means 305. When the door 315 is opened, the rack member 363 is moved to the lowered position LP by the link mechanism 350 so that the rack portion 363*a* is engaged with the first gear 23 and the second gear 24. The belt 5*a* of the transfer means 305 is in contact with the drums 1. When the transfer means 305 is removed from the apparatus main body 300, the user pulls out the transfer means 305 in the removing direction MX. If the transfer means 305 is moved in the removing direction MX in a state in which the rack portion 363 is engaged with the first gear 23 and the second gear 24, the first gear 23 and the second gear 24 are rotated by the rack portion 363 in a counterclockwise direction indicated by an arrow G in FIG. 13B. The second gear 24 rotates the second suspension roller 71 and the belt 5*a* in a counterclockwise direction. At this time, the movement direction of the belt 5*a* on the side of the primary transfer surface 5*t* becomes the opposite direction to the removing direction MX of the transfer means 305. With this, the relative speed at the contact areas between the drums 1 and the belt 5*a* is made smaller, thereby being capable of preventing a scratch from being marked on the surfaces of the drums 1 or the surface of the belt 5*a*. Further, as in Embodiment 1, the reference pitch circle radius R1 of the second gear 24 is set so as to have the same value as a value obtained by adding a thickness "t" of the belt 5*a* to an outer peripheral surface radius R2 of the rubber layer 71*b* of the second suspension roller 71. Therefore, on the side of the primary transfer surface 5*t*, the belt 5*a* moves in the direction which is opposite to the removing direction MX of the transfer means 305 at the same magnitude of speed as the pull out speed of the transfer means 305. With this operation, the relative speed, when the transfer means 305 is pulled out, at the contact areas between the drums 1 and the belt 5*a* becomes substantially zero. In other words, at the contact areas between the belt 5*a* and the drums 1, the belt 5*a* does not relatively move with respect to the drums 1. Accordingly, even if the belt 5*a* is in contact with the drums 1, it is possible to prevent a scratch from being marked on the surfaces of the drums 1 or the surface of the belt 5*a* because of the reduction in rubbing of the belt 5*a* against the drums 1. As the transfer means 305 may be moved while the belt 5*a* is in contact with the drums 1, the transfer means 305 may be removed from the apparatus main body 300 by only moving the transfer means 305 in one direction from the mounting position MP. Accordingly, the operation at the time of removing the transfer means 305 is facilitated.

When the transfer means 305 is further moved in the removing direction MX, the engagement between the second gear 24 and the rack portion 363*a* is disengaged, and the transfer means 305 reaches the removing position DP. At the removing position DP, the to-be-guided ribs 305*b* provided on the transfer means 305 is removed from the guide grooves 380 provided in the apparatus main body 300, and then the transfer means 305 is removed from the apparatus main body 300.

When the transfer means 305 is mounted to the apparatus main body 300, a reverse operation to the above-mentioned removing operation is performed. The user engages, at the removing position DP, the ribs of the transfer means 305 with the guide grooves 380 provided in the apparatus main body 300. If the transfer means 305 is pushed in the mounting direction indicated by the arrow MY in FIG. 13B, the second gear 24 engages with the rack portion 363*a*. In association with the movement of the transfer means 305 in the mounting direction MY along the movement route M, the second gear 24 is rotated by the rack portion 363*a* in a clockwise direction opposite to the direction indicated by the arrow G. The second gear 24 rotates the roller 71 and the belt 5*a* in the clockwise direction. At this time, the movement direction of the belt 5*a* on the side of the primary transfer surface 5*t* becomes the direction opposite to the mounting direction MY of the transfer means 305. With this, the relative speed at the contact areas between the drums 1 and the belt 5*a* is made smaller, thereby being capable of preventing a scratch from being marked on the surfaces of the drums 1 or the surface of the belt 5*a*. On the side of the primary transfer surface 5*t*, the belt 5*a* is moved in a direction which is opposite to the mounting direction MY of the transfer means 305 at the same magnitude of speed as the push-in speed of the transfer means 305. With this operation, the relative speed at the contact areas between the drums 1 and the belt 5*a* when mounting the transfer means becomes substantially zero. In other words, at the contact areas between the belt 5*a* and the drum 1, the belt 5*a* does not relatively move with respect to the drums 1. Accordingly, even if the belt 5*a* is in contact with the drums 1, it is possible to prevent a scratch from being marked on the surfaces of the drums 1 or the surface of the belt 5*a* because of the reduction in rubbing of the belt 5*a* against the drums 1. As the transfer means 305 may be moved while the belt 5*a* is in contact with the drums 1, the transfer means 305 may be mounted to the apparatus main body 300 by only moving the transfer means 305 from the removing position DP in the mounting direction MY. Accordingly, the operation at the time of mounting the transfer means 305 is facilitated.

The user closes the door 315 after mounting the transfer means 305 to the mounting position MP. When the door 315 is closed, the rack member 363 is moved to the raised position UP by the link mechanism 350 so that the rack portion 363*a* is separated from the first gear 23 and the second gear 24. Accordingly, the first suspension roller 70 can be rotated by a motor (not shown) to rotate the belt 5*a* for an image formation.

(Mount and Removal Operation of Process Cartridge Supporting Member)

At the time of the maintenance or replacement of the process cartridge supporting member 361, the user opens the door 315, and performs the removal and mounting of the supporting member 361. When the door 315 is opened, the rack member 363 is moved to the lowered position LP by the link mechanism 350 so that the rack portion 363*a* is engaged with the first gear 23 and the second gear 24. The belt 5*a* of the transfer means 305 is in contact with the drums 1. When the supporting member 361 is removed from the apparatus main body 300, the user pulls out the supporting member 361 in the removing direction. If the supporting member 361 is moved in the removing direction in a state in which the rack portion 363 is engaged with the first gear 23 and the second gear 24, the first gear 23 is rotated by the rack portion 363 in the clockwise direction indicated by the arrow G in FIG. 13B. The first gear 23 rotates the roller 70 and the belt 5*a* in the clockwise direction. At this time, the moving direction of the belt 5*a* on the side of the primary transfer surface 5*t* becomes the same direction as the pull-out direction of the supporting member 361. Similarly to the second gear 24, the reference pitch circle radius R1 of the first gear 23 is set so as to have the same value as a value obtained by adding the thickness "t" of the belt 5*a* to the outer peripheral surface radius R2 of the rubber layer 70*b* of the roller 70. Therefore, on the side of the primary transfer surface 5*t*, the belt 5*a* is moved in the same direction as the removing direction of the supporting member 361 at the same magnitude of speed as the pull-out speed of the supporting member 361. With this, the relative speed at the contact areas between the drums 1 and the belt 5*a* when pulling out the supporting member 361 becomes substantially zero. In other words, at the contact areas between the belt 5*a* and the drums 1, the belt 5*a* does not relatively move with respect to the drums 1. Accordingly, even if the belt 5*a* is in contact with the drums 1, it is possible to prevent a scratch from being marked on the surfaces of the drums 1 or the surface of the belt 5*a* because of the reduction in rubbing of the belt 5*a* against the drums 1. As the transfer means 5 can be moved while the belt 5*a* is in contact with the drums 1, the supporting member 361 can be removed from the apparatus main body 300 by only moving the supporting member 361 in one direction from the mounting position MP. Accordingly, the operation at the time of removing the supporting member 361 is facilitated.

When the supporting member 361 is further moved in the removing direction, the engagement between the first gear 23 and the rack portion 363*a* is released, and the supporting member 361 reaches the outside position OP. At the outside position OP, the to-be-guided ribs 360*b* provided on the supporting member 361 is removed from the guide grooves 381 provided in the apparatus main body 300, and then the supporting member 361 is removed from the apparatus main body 300.

When the supporting member 361 is mounted to the apparatus main body 300, a reverse operation to the above-mentioned removing operation is performed. The user engages, at the outside position OP, the ribs 360*b* of the supporting member 361 with the guide grooves 381 provided in the apparatus main body 300. If the supporting member 361 is pushed in the mounting direction, the rack portion 363*a* engages with the first gear 23. In association with the movement of the supporting member 361 in the mounting direction along the movement route N, the first gear 23 is rotated in the counterclockwise direction by the rack portion 363*a*. The first gear 23 rotates the first suspension roller 70 and the belt 5*a* in the counterclockwise direction. At this time, the movement direction of the belt 5*a* on the side of the primary transfer surface 5*t* becomes the same direction as the mounting direction of the supporting member 361. On the side of the primary transfer surface 5*t*, the belt 5*a* is moved in the same direction as the mounting direction of the supporting member 361 at the same magnitude of speed as the push-in speed of the supporting member 361. With this operation, the relative speed at the contact areas between the drums 1 and the belt 5*a* when mounting the supporting member 361 becomes substantially zero. In other words, at the contact areas between the belt 5*a* and the drums 1, the belt 5*a* does not relatively move with respect to the drums 1. Accordingly, even if the belt 5*a* is in contact with the drums 1, it is possible to prevent a scratch from being marked on the surfaces of the drums 1 or the surface of the belt 5*a* because of the reduction in rubbing of the belt 5*a* against the drums 1. As the supporting member 361 can be moved while the belt 5*a* is in contact with the drums 1, the supporting member 361 can be mounted to the apparatus main body 300 by only moving the supporting member 361 from the outside position OP in the mounting direction. Accordingly, the operation at the time of mounting the supporting member 361 is facilitated.

The user closes a door 315 after mounting the supporting member 361 to the inside position IP. When the door 315 is closed, the rack member 363 is moved to the raised position UP by the link mechanism 350 so that the rack portion 363*a* is separated from the first gear 23 and the second gear 24. Accordingly, the first suspension roller 70 can be rotated by the motor (not shown) for rotating the belt 5*a* for an image formation.

Note that, in the above-mentioned Embodiments 1 to 3, the movement route of the transfer means is in parallel with the straight line direction (the arrangement direction) in which the plurality of drums are aligned. However, the movement route of the transfer means is not limited to the arrangement direction of the drums. For example, in the image forming apparatus, which is so constructed that some drums among the plurality of drums are allowed to contact and separate from the belt, the transfer means may be constructed so as to be movable in a direction different from the drum arrangement direction.

In the related art, in which after separating the drums from the transfer belt, the separating direction of separating the drums from the transfer belt and the removing direction of removing the transfer means from the apparatus main body differs from each other. For that reason, in the related art, the operability for mounting and removing the transfer means from the apparatus main body was not satisfactory. Contrary to this, according to this Embodiment, the operating direction of the transfer means for mounting and removing thereof becomes substantially in a line, and hence the operability for mounting and removing the transfer means at the time of the maintenance thereof may be enhanced.

Further, in the related art, in order to separate the drums from the transfer belt, there was required a space which allows the transfer means to move in a separating direction.

Country to this, according to this Embodiment, such space may be omitted, thereby being capable of down-sizing of the image forming apparatus.

Further, in the above-mentioned Embodiments 1 to 3, the present invention is described by way of the transfer means which uses the intermediate transfer belt as an example, but the present invention is not limited to the image forming apparatus which uses the intermediate transfer member. The present invention may be applied to the transfer means which uses, in place of the intermediate transfer belt, a belt-like recording medium conveying member which conveys a recording medium to the drums of the process cartridges.

Further, in this embodiment, the present invention is described by way of example of the electrophotographic photosensitive drum of the process cartridge, but the present invention is not limited thereto. The electrophotographic photosensitive drums may be rotatably fixed to the process cartridge supporting member which is detachable from the image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-152817, filed Jul. 5, 2010, which is hereby incorporated by reference herein in its entirety.

What is claimed is:

1. An electrophotographic image forming apparatus for forming an image on a recording medium, the electrophotographic image forming apparatus comprising:

a plurality of electrophotographic photosensitive drums;

transfer means for rotatably supporting a transfer member for transferring toner images formed on the plurality of electrophotographic photosensitive drums onto the recording medium, the transfer means being movable, in a state in which the transfer member is in contact with at least one of the plurality of electrophotographic photosensitive drums, between a mounting position inside an apparatus main body of the electrophotographic image forming apparatus, at which the transfer means is mounted to the apparatus main body and a removing position outside the apparatus main body, at which the transfer means is removed from the apparatus main body; and rotative force generating means for generating a rotative force for rotating the transfer member in association with a movement of the transfer means, when the transfer means is moved from the mounting position to the removing position in a removing direction and when the transfer means is moved in a mounting direction from the removing position to the mounting position.

2. An electrophotographic image forming apparatus according to claim 1, wherein the rotative force generating means generates, when the transfer means is moved in the removing direction from the mounting position to the removing position, a rotative force in association with the movement of the transfer means for rotating the transfer member in one direction, to move a transfer surface of the transfer member, which is in contact with at least one of the plurality of electrophotographic photosensitive drums, with respect to the transfer means in a direction opposite to the removing direction, and the rotative force generating means generates, when the transfer means is moved from the removing position to the mounting position in the mounting direction, a rotative force in association with the movement of the transfer means for rotating the transfer member in a direction opposite to the one direction, to move the transfer surface of the transfer member with respect to the transfer means in a direction opposite to the mounting direction.

3. An electrophotographic image forming apparatus according to claim 2, wherein the rotative force generating means generates, when the transfer means is moved from the mounting position to the removing position and when the transfer means is moved from the removing position to the mounting position, a rotative force in association with the movement of the transfer means for rotating the transfer member so that a relative speed between the at least one of the plurality of electrophotographic photosensitive drums and the transfer member becomes zero at a position at which the at least one of the plurality of electrophotographic photosensitive drums is in contact with the transfer member.

4. An electrophotographic image forming apparatus according to claim 3, wherein the transfer member comprises an intermediate transfer belt, onto which the toner images formed on the plurality of electrophotographic photosensitive drums are primarily transferred and superimposed, and from which the superimposed toner images are secondarily transferred onto the recording medium.

5. An electrophotographic image forming apparatus according to claim 3, wherein the transfer member comprises a transfer belt, which conveys the recording medium and transfers the toner images formed on the plurality of electrophotographic photosensitive drums onto the recording medium.

6. An electrophotographic image forming apparatus according to claim 5, wherein the transfer member is looped around a first rotary member and a second rotary member, which are rotatably supported by the transfer means, the first rotary member is disposed downstream in the removing direction, the second rotary member is disposed upstream in the removing direction, and the rotative force generating means generates a rotative force for rotating the second rotary member disposed upstream in the removing direction.

7. An electrophotographic image forming apparatus according to claim 6, wherein the rotative force generating means comprises:

a rack portion extending along a movement route of the transfer means which moves between the mounting position and the removing position;

a driven gear, which is rotatably supported by a rotation shaft of the second rotary member and meshes with the rack portion; and a clutch means, which assumes a transmitting position at which the rotative force of the driven gear, which rotates by being meshed with the rack portion, is transmitted to the second rotary member, and a shutoff position at which a transmission of the rotative force from the second rotary member to the driven gear is shut-off.

8. An electrophotographic image forming apparatus according to claim 7, wherein the apparatus main body has an opening portion through which the transfer means is moved between the mounting position and the removing position, and the electrophotographic image forming apparatus further comprises:

an openable and closable member, which opens and closes the opening portion; and interlocking means for causing the clutch means to assume the shutoff position when the openable and closable member closes the opening portion, and for causing the clutch means to assume the transmitting position when the openable and closable member opens the opening portion.

9. An electrophotographic image forming apparatus according to claim 8, further comprising:

a plurality of process cartridges each including one of the plurality of electrophotographic photosensitive drums, and process means which acts on the one of the electrophotographic photosensitive members; and a process cartridge supporting member for supporting the plurality of process cartridges, the process cartridge supporting member being movable between an inside position positioned inside the apparatus main body and an outside position positioned outside the apparatus main body in a state in which the process cartridge supporting member supports the plurality of process cartridges, wherein the rack portion is provided on the process cartridge supporting member.

10. An electrophotographic image forming apparatus according to claim 6, wherein the rotative force generating means comprises:

a rack portion extending along a movement route of the transfer means which moves between the mounting position and the removing position;

a driven gear, which rotates integrally with a rotation shaft of the second rotary member;

an intermediate gear, which meshes with the driven gear; and a raising and lowering member, which raises the rack portion to a raised position at which the rack portion meshes with the intermediate gear, and lowers the rack portion to a lowered position at which the rack portion is separated from the intermediate gear.

11. An electrophotographic image forming apparatus according to claim 10, wherein the apparatus main body has an opening portion through which the transfer means is moved between the mounting position and the removing position, and the electrophotographic image forming apparatus further comprises:

an openable and closable member, which opens and closes the opening portion; and interlocking means for causing the raising and lowering member to position at the lowered position when the openable and closable member closes the opening portion, and for causing the raising and lowering member to position at the raised position when the openable and closable member opens the opening portion.

12. An electrophotographic image forming apparatus according to claim 11, further comprising resistance giving means for giving a resistance to put a brake on the movement of the transfer means which is moved in the removing direction from the mounting position to the removing position, and on the movement of the transfer means which is moved in the mounting direction from the removing position to the mounting position.

13. An electrophotographic image forming apparatus for forming an image on a recording medium, the electrophotographic image forming apparatus comprising:

a plurality of electrophotographic photosensitive drums;

transfer means for rotatably supporting a transfer member for transferring toner images formed on the plurality of electrophotographic photosensitive drums onto a recording medium, the transfer means being movable, in a state in which the transfer member is in contact with at least one of the plurality of electrophotographic photosensitive drums, between a mounting position inside an apparatus main body of the electrophotographic image forming apparatus, at which the transfer means is mounted to the apparatus main body and a removing position outside the apparatus main body, at which the transfer means is removed from the apparatus main body;

rotative force generating means for generating a rotative force for rotating the transfer member in association with a movement of the transfer means when the transfer means is moved in a removing direction from the mounting position to the removing position and when the transfer means is moved in a mounting direction from the removing position to the mounting position;

a plurality of process cartridges each including one of the plurality of electrophotographic photosensitive drums, and process means for acting on the one of the electrophotographic photosensitive drum; and a process cartridge supporting member, which supports the plurality of process cartridges, wherein the process cartridge supporting member is movable, in a state in which the process cartridge supporting member supports the plurality of process cartridges, between an inside position positioned inside the apparatus main body and an outside position positioned outside the apparatus main body, and the rotative force generating means generates the rotative force for rotating the transfer member in association with a movement of the process cartridge supporting member, when the process cartridge supporting member is moved in a removing direction from the inside position to the outside position and when the process cartridge supporting member is moved in a mounting direction from the outside position to the inside position.

14. An electrophotographic image forming apparatus according to claim 13, wherein the transfer member is looped around a first rotary member and a second rotary member, which are rotatably supported by the transfer means, the first rotary member is disposed downstream in the removing direction, the second rotary member is disposed upstream in the removing direction, and the rotative force generating means generates the rotative force for rotating the second rotary member disposed upstream in the removing direction in association with the movement of the transfer means, and the rotative force for rotating the first rotary member disposed downstream in the removing direction in association with the movement of the process cartridge supporting member.

* * * * *